US005177311A

United States Patent [19]

Suzuki et al.

[11] Patent Number: 5,177,311

[45] Date of Patent: Jan. 5, 1993

[54] MUSICAL TONE CONTROL APPARATUS

[75] Inventors: Hideo Suzuki; Mamoru Kimpara; Masao Sakama; Akira Nakada; Masahiko Obata, all of Hamamatsu, Japan

[73] Assignee: Yamaha Corporation, Hamamatsu, Japan

[21] Appl. No.: 631,213

[22] Filed: Dec. 21, 1990

Related U.S. Application Data

[63] Continuation of Ser. No. 143,832, Jan. 13, 1988, abandoned.

[30] Foreign Application Priority Data

| | | | |
|---|---|---|---|
| Jan. 14, 1987 | [JP] | Japan | 62-6848 |
| Feb. 4, 1987 | [JP] | Japan | 62-23880 |
| Feb. 4, 1987 | [JP] | Japan | 62-23881 |
| Feb. 6, 1987 | [JP] | Japan | 62-25889 |
| Feb. 6, 1987 | [JP] | Japan | 62-25890 |
| Feb. 6, 1987 | [JP] | Japan | 62-25891 |
| Feb. 20, 1987 | [JP] | Japan | 62-37294 |
| Apr. 9, 1987 | [JP] | Japan | 62-87455 |
| Apr. 9, 1987 | [JP] | Japan | 62-87456 |
| Apr. 9, 1987 | [JP] | Japan | 62-87458 |

[51] Int. Cl.[5] ..... G10H 5/00

[52] U.S. Cl. ..... 84/600; 84/678; 84/687; 84/701; 84/DIG. 12

[58] Field of Search ..... 84/DIG. 12, 422 R, 422 S, 84/1.01, 1.03, 1.1, 1.27, 1.19, 477 B, 1.13, 422 C, 422 H, 1.26, 678, 687, 692, 701, 702, 703, 718, 600, 422.1-422.4; 200/61.47, 61.46, 61.45, 61.51, 61.52, 61.48; D17/22-24; 367/99, 116; 324/162; 340/384 R, 384 E

[56] References Cited

U.S. PATENT DOCUMENTS

| | | | |
|---|---|---|---|
| 3,270,119 | 8/1966 | Griffith . | |
| 3,893,364 | 7/1975 | Harrison | 84/422 S |
| 4,282,681 | 8/1981 | McCaslin | 200/DIG. 2 X |
| 4,341,140 | 7/1982 | Ishida | 84/DIG. 12 X |
| 4,352,310 | 10/1982 | Orlandoni | 84/1.01 |
| 4,450,325 | 5/1984 | Luque | 200/6 AX |
| 4,503,299 | 3/1985 | Henrard et al. | 200/6 A X |
| 4,719,836 | 1/1988 | Baumgart | 84/422.5 |
| 4,753,146 | 6/1988 | Seiler | 84/DIG. 12 X |
| 4,909,117 | 3/1990 | Reiling et al. | 84/738 |
| 4,955,294 | 2/1991 | Kashio et al. | 84/738 |
| 4,998,457 | 3/1991 | Suzuki et al. | 84/600 |
| 5,062,341 | 11/1991 | Reiling et al. | 84/702 |

FOREIGN PATENT DOCUMENTS

| | | | |
|---|---|---|---|
| 2224061 | 10/1974 | France . | |
| 2183076 | 5/1987 | United Kingdom | 84/422.5 |

OTHER PUBLICATIONS

"Radar for the Blind," Elektor, May, 1981, pp. 5-02 to 5-03.

*Primary Examiner*—A. T. Grimley
*Assistant Examiner*—Matthew S. Smith
*Attorney, Agent, or Firm*—Graham & James

[57] ABSTRACT

The musical tone control apparatus includes at least a sensor for detecting a movement of a player and a control circuit for controlling a tone element of a musical tone to be generated based on the detected movement of the player. The sensor may be equipped within a stick or mounted at predetermined portion of the player. As the movement of the player, the sensor can detect a swinging angle of a player's arm, an acceleration applied thereto or a distance between a player's hand and a predetermined object such as a wall. As the tone element of the musical tone, the control circuit controls a tone color, a tone pitch or a tone volume of the musical tone.

46 Claims, 21 Drawing Sheets

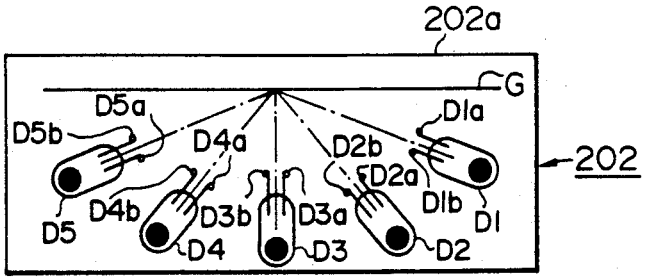
Fig.18
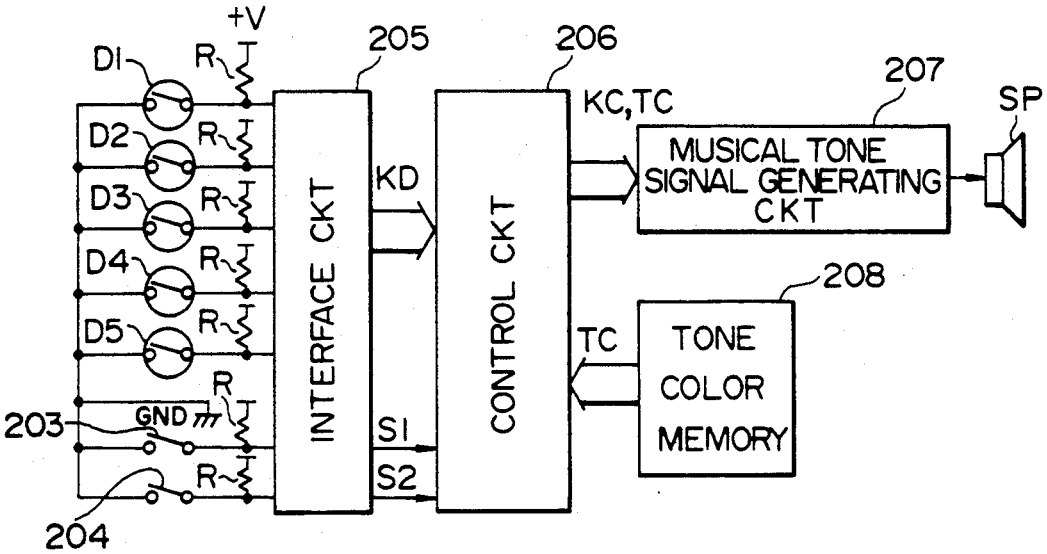
Fig.19
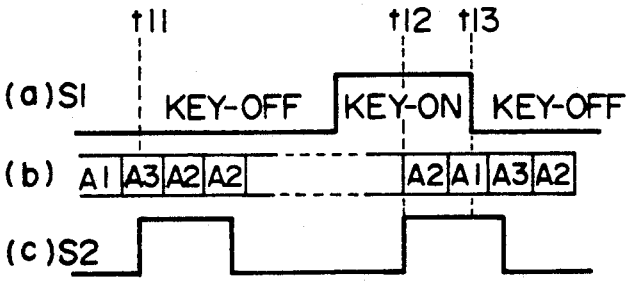
Fig.20
| | ANGLE RANGE | TONE COLOR |
|---|---|---|
| A1 | 0°-30° | Piano1 |
| A2 | 30°-60° | Piano2 |
| A3 | 60°-90° | Harp |
| A4 | 90°-120° | Elepiano |
| A5 | 120°-150° | Trampet |
Fig.21

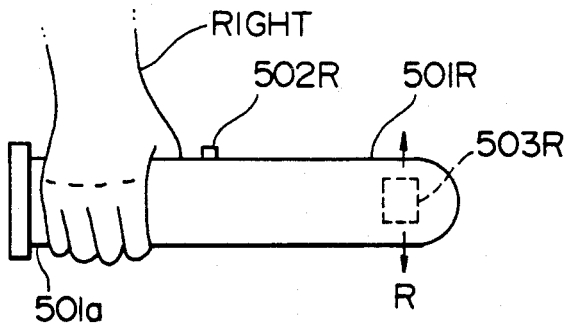
Fig.27
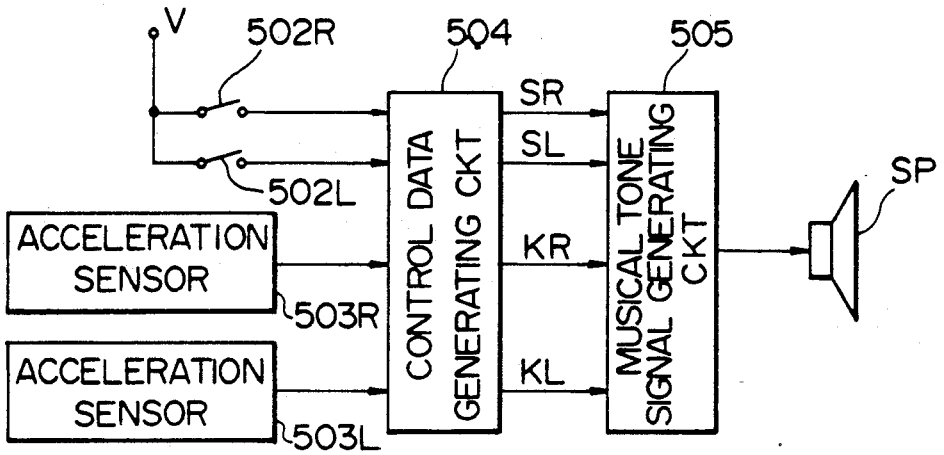
Fig.28
| SR | SL | KR | KL |
|---|---|---|---|
| "0" | "0" | T1 | T2 |
| "0" | "1" | T3 | T4 |
| "1" | "0" | T5 | T6 |
| "1" | "1" | T7 | T7 |
Fig.29

803
3.6
803b
rb
76.9°=nb
CR

B2
803
12.4
CR

A2
803a
50.6°
=na
ra
rd
45°=n4
801R
rc
37.5°=n3
rb
803
45°=n2
D2
ra
K2
30°
=n1

C2
803
803d
rd
CR
67.2°=nd
12.5

803
CR
803c
rc
3.6
50
81.7°=nc

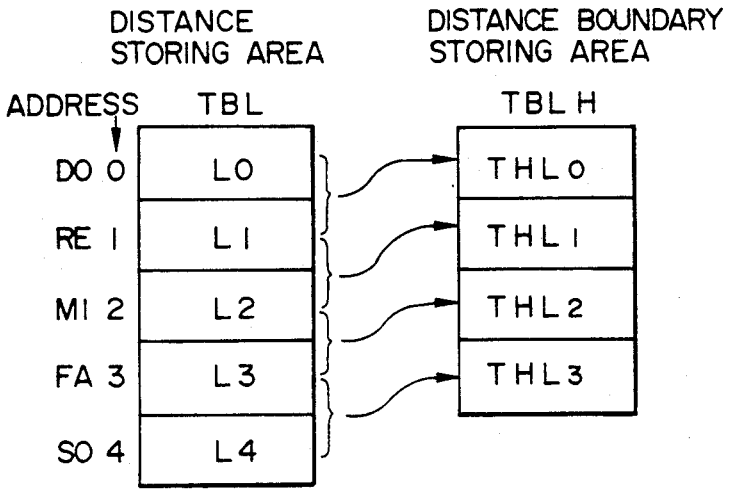
Fig.48
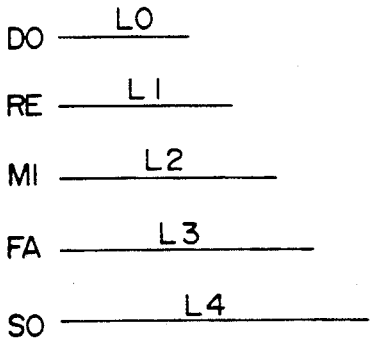
Fig.49A
$$THL\,0 \leftarrow \frac{L1+L0}{2}$$
$$THL\,1 \leftarrow \frac{L2+L1}{2}$$
$$THL\,2 \leftarrow \frac{L3+L2}{2}$$
$$THL\,3 \leftarrow \frac{L4+L3}{2}$$
Fig.49B
j=0 DO L: 0 ~ THL0
j=1 RE L: THL0 ~ THL1
j=2 MI L: THL1 ~ THL2
j=3 FA L: THL2 ~ THL3
j=4 SO L: MORE THAN THL3
Fig.49C

MUSICAL TONE CONTROL APPARATUS

This is a continuation of application Ser. No. 143,832 filed on Jan. 13, 1988, now abandoned.

BACKGROUND OF THE INVENTION

The present invention generally relates to a musical tone control apparatus, and more particularly to a musical tone control apparatus which controls a musical tone in response to a body action and a hand or arm swinging action of a player when the player practices a rhythm gymnastics.

As well known in an electronic keyboard musical instrument, the player operates keys and several kinds of operating elements for controlling musical tones by use of his hands and feet to thereby select a desirable tone pitch, a desirable tone color and the like, for example. Thus, the player plays the electronic keyboard musical instrument.

Meanwhile, the electronic keyboard musical instrument can not select the tone pitch without depressing the keys by his hands or feet. Hence, the performance method of the musical tone must be limited.

Therefore, the present applicant proposed a musical tone control apparatus (i.e., U.S. patent application Ser. No. 108,205) which controls the musical tone to be generated in response to the hand or arm swinging action of the player. Next, description will be given with respect to a first example of this proposed musical tone control apparatus in conjunction with FIGS. 1 to 5.

In FIG. 1, a base portion 1*a* of a stick 1 is held by a player's hand H, and an angle detector 2 (or an angle sensor 2) is equipped within a tip end portion 1*b* of the stick 1.

As shown in FIG. 2, the angle detector 2 is constructed by a support plate 3 and four mercury switches "a" to "d" fitted to the support plate 3. These mercury switches "a" to "d" have respective center axes Ja to Jd which form respective angles of 22.5 degrees, 67.5 degrees, 112.5 degrees and 157.5 degrees with respect to a reference line L. Each of these mercury switches "a" to "d" is constructed by a glass tube 4 in which a certain quantity of mercury liquid 5 as shown in FIG. 3 is sealed. Both end portions of this glass tube 4 are tightly closed, and a pair of electrodes 6*a* and 6*b* are inserted through one end portion of the glass tube 4 by certain lengths thereof. In a state shown in FIG. 3, the mercury liquid 5 does not turn on the electrodes 6*a* and 6*b* because the electrode 6*a* does not come into contact with another electrode 6*b* via the mercury liquid 5. As the mercury switch shown in FIG. 3 is revolved in a direction A, the mercury liquid 5 will turn on the electrodes 6*a* and 6*b*.

When the angle detector 2 shown in FIG. 2 is revolved around a reference point O, some of the mercury switches "a" to "d" will be turned on in a manner as shown in FIG. 4. First, in an initial state as shown in FIG. 2, all of the mercury switches "a" to "d" are turned off. Secondly, the angle detector 2 is revolved by 45 degrees around the reference point O in a direction B (i.e., a counterclockwise direction) so that the mercury switch "a" is only turned on. Thirdly, the angle detector 2 is further revolved by 45 degrees around the reference point 0 in the direction B so that the mercury switches "a" and "b" are turned on. Similarly, at every time when the angle detector 2 is revolved by 45 degrees around the reference point O in the direction B, the mercury switches which are turned on will be changed as three mercury switches "a", "b" and "c"; the four mercury switches "a" to "d"; the three mercury switches "b", "c" and "d"; the two mercury switches "c" and "d"; and the one mercury switch "d".

Next, FIG. 5 is a block diagram showing a first example of the proposed musical tone control apparatus. Based on on/off states of the mercury switches "a" to "d", a musical tone control circuit 7 detects an angle of the angle detector 2 against the ground, i.e., a swinging angle of the player's hand H holding the stick 1. Hence, the musical tone control circuit 7 outputs tone pitch data KD corresponding to the detecting result thereof. Such tone pitch data KD are supplied to a musical tone signal generating circuit 8 wherein a musical tone signal corresponding to the tone pitch data KD is generated. This musical tone signal is outputted to a speaker 9, whereby the speaker 9 generates a musical tone having a tone pitch corresponding to the swinging angle of the player's hand H.

In the above-mentioned first example of the proposed musical tone control apparatus, the following problems (1) to (5) occur.

(1) In the case where an additional switch is equipped to the stick 1 so as to selectively change the tone color of the musical tone, only one or two switches are considered to be equipped to the stick 1 because of the shape of the stick 1. Hence, this former musical tone control apparatus suffers a problem in that it is difficult to arbitrarily change the tone color of the musical tone by use of such a few switches.

(2) The angle detector 2 within the stick 1 can detect the arm swinging angle of the player with accuracy when he swings up his arm with a relatively slow speed. However, when the player swings the stick 1 violently with a high speed, the angle detector 2 can not detect the arm swinging angle of the player with accuracy. In such case, an acceleration sensor is considered to be used for detecting a violent movement of the player's arm because this acceleration sensor can output a signal having a level corresponding to the acceleration applied thereto, for example. However, the stick 1 according to the former musical tone control apparatus can be equipped with only one sensor. Hence, the former musical tone control apparatus is burdensome in that this apparatus must provide two sticks which are equipped with the angle sensor and the acceleration sensor independently.

(3) In each of the mercury switches "a" to "d", the mercury liquid 5 turns on or off the electrodes 6*a* and 6*b* because the mercury liquid 5 normally moves downward under an effect of the gravitation. Hence, when the player swings up and down his hand H holding the stick 1, an impulse force and a centrifugal force have an effect on the angle detector 2 remarkably. For this reason, the angle detector 2 may commit an error operation. In addition, a minute movement or vibration of the player's hand H is likely to be amplified to a relatively large movement or vibration at the tip end portion 1*b* of the stick 1. As a result, the angle detector 2 may commit an error operation again.

(4) Meanwhile, the player's arm can freely move and revolve around his shoulder joint. Considering for a revolving movement of the player's arm in his right or left direction, his hand traces along an inner periphery of an imaginary circular cone having a top of the shoulder joint, for example. In addition, when the player revolves his arm sideward, the stick 1 must be twisted in accordance with a twisting movement of the player's wrist because of constructions of joints of his arm. For this reason, the angle detector 2 can not detect the arm swinging angle of the player with accuracy. More specifically, when the angle detector 2 is revolved within a two-dimensional plane including the plane of the support plate 3, the angle detector 2 can detect the swinging angle of the player's arm with accuracy. On the contrary, when the above-mentioned twisting movement of the player's wrist causes the support plate 3 to revolve in a direction perpendicular to the plane of the support plate 3, the angle detector 2 can not detect the swinging angle of the player's arm with accuracy. Furthermore, since the mercury switches "a" to "d" are arranged radially around the reference point O, the scale of the angle detector 2 must become large.

(5) Due to the above-mentioned arrangement of the mercury switches "a" to "d", the player must hold and keep the stick 1 such that the support plate 3 must be normally located within the two-dimensional plane including the plumb line, whereby the stick 1 functions as the musical tone control apparatus.

However, since the stick 1 has a cylindrical shape as shown in FIG. 1, the player can hold the stick 1 as he likes. For this reason, it is difficult to recognize the direction in which the support plate 3 of the angle detector 2 faces.

Next, description will be given with respect to a second example of the proposed musical tone control apparatus in conjunction with FIGS. 6 to 9.

FIG. 6 shows an essential appearance of this second example of the proposed musical tone control apparatus which controls the musical tone in response to the body action in the rhythm gymnastics and the like. In FIG. 6, a stick S having a cylindrical shape provides a key-on switch 11 equipped near a holding portion thereof. The player puts a mounting wear W on an upper half of his body, and a supporter P made of flexible materials such as rubber is mounted at a shoulder joint portion of the mounting wear W. As shown in FIG. 7, a potentiometer 13 of an angle detector 12 is mounted around a center portion of the supporter P. One edge portion of a lever 14 is fixed to a shaft 13*a* of the potentiometer 13, and the other edge portion of the lever 14 can be freely put in and out from a cylinder 15 as shown in FIG. 8. Within an inner portion of the cylinder 15, a spring 16 is provided in order to pull the lever 14 therein. In addition, a fixing portion 15*a* is formed at an edge portion of the cylinder 15 and mounted at a certain upper arm portion of the mounting wear W.

When the player swings up his right arm shown in FIG. 6, the lever 14 and the cylinder 15 are revolved in response to the swinging movement of the player so that the shaft 13*a* must be revolved. Hence, the revolving angle of the shaft 13*a* corresponds to the arm swinging angle of the player, and the angle detector 12 outputs a detection signal C1 corresponding to the arm swinging angle to an angle detecting circuit 17 shown in FIG. 9. The angle detecting circuit 17 generates angle data KD the value of which corresponds to the level of the detection signal C1, and such angle data KD are supplied to a musical tone control circuit 18. This musical tone control circuit 18 monitors the on/off states of the key-on switch 11 mounted on the stick S. When the musical tone control circuit 18 detects that the key-on switch 11 is turned on, the musical tone control circuit 18 generates key-on data KOD and tone pitch data KC corresponding to the angle data KD. The tone pitch data KC and the key-on data KOD are supplied to a musical tone signal generating circuit 19. On the other hand, when the musical tone control circuit 18 detects that the key-on switch 11 is turned off, the musical tone control circuit 18 generates and outputs key-off data KFD to the musical tone signal generating circuit 19. When the musical tone signal generating circuit 19 inputs the key-on data KOD, the musical tone signal generating circuit 19 generates a musical tone signal having a tone pitch corresponding to the tone pitch data KC so as to drive a speaker SP. On the other hand, when the musical tone signal generating circuit 19 inputs the key-off data KFD, the musical tone signal generating circuit 19 stops generating the musical tone.

As described heretofore, when the player holds the stick S by his right hand and depresses the key-on switch 11 while the player swings up his right arm, this musical tone control apparatus shown in FIG. 6 generates the musical tone having the tone pitch corresponding to the arm swinging angle of the player. Then, this musical tone control apparatus stops generating the musical tone when the player releases the key-on switch 11.

In order to properly generate the musical tone having the desirable tone pitch when the player plays a musical tune having a rapid tempo, it is preferable to set a range of the arm swinging angle of the player relatively narrow. In this case, a relation between the arm swinging angle and the tone pitch to be generated must be changed in accordance with a changing range of the arm swinging angle. However, the former musical tone control apparatus can not change such relation between the arm swinging angle and the tone pitch to be generated.

SUMMARY OF THE INVENTION

It is therefore a primary object of the invention to provide a musical tone control apparatus which can detect the arm swinging angle of the player with accuracy and control a generation of the musical tone in response to the detected arm swinging angle.

It is a second object of the invention to provide a musical tone control apparatus, the outside dimension of which can be minimized.

It is a third object of the invention to provide a musical tone control apparatus which can generate the musical tones having several kinds of the tone pitches which can be selected by use of a few switches.

It is a fourth object of the invention to provide a musical tone control apparatus which can provide several kinds of sensors within one stick.

It is a fifth object of the invention to provide a musical tone control apparatus which can recognize the arm swinging angle of the player visually and also minimize the effects of the impulse force and the centrifugal force both causing a detection error.

It is a sixth object of the invention to provide a musical tone control apparatus which provides means for easily detecting how the player holds the stick.

It is a seventh object of the invention to provide a musical tone control apparatus which can freely change a relation between the body action of the player and musical tone control data to be generated based on such body action of the player.

In a first aspect of the invention, there is provided a musical tone control apparatus for controlling a generation of a musical tone in a musical tone generating apparatus comprising: (a) a stick which can be held by a player's hand; (b) switching means mounted on the stick; (c) a tone color memory for storing tone color information representative of a plurality of tone colors; and (d) control means for reading desirable tone color information corresponding to an operating state of the switching means from the tone color memory, the control means outputting the desirable tone color information to the musical tone generating apparatus wherein a musical tone having a tone color corresponding to the desirable tone color information is generated.

In a second aspect of the invention, there is provided a musical tone control apparatus for controlling a musical tone to be generated comprising: (a) a stick having a shape which can be held by a player's hand; (b) selecting means for selecting a tone volume and a tone color of the musical tone, the selecting means being mounted on or in the stick; (c) memory means for storing a plurality of tone colors; and (d) control means for reading a desirable tone color selected by the selecting means from the memory means, the control means outputting a desirable tone volume designated by the selecting means whereby a musical tone having the desirable tone color and the desirable tone volume is to be generated.

In a third aspect of the invention, there is provided a musical tone control apparatus for controlling a generation of a musical tone in a musical tone generating apparatus comprising: (a) a stick which can be held by a player's hand; (b) switching means mounted on the stick; (c) angle detecting means for detecting a swinging angle of the stick when the player swings up the stick, the angle detecting means being equipped within the stick; (d) a tone color memory for storing tone color information representative of a plurality of tone colors; and (e) control means for reading a desirable tone color information from the tone color memory in accordance with an operating state of the switching means and a detecting result of the angle detecting means, the desirable tone color information being outputted to the musical tone generating apparatus, whereby a tone color of a musical tone to be generated is controlled by the desirable tone color information.

In a fourth aspect of the invention, there is provided a musical tone control apparatus for controlling a musical tone to be generated comprising: (a) a stick having a shape which can be held by a player's hand; (b) a first switch for controlling a tone pitch of the musical tone; (c) a second switch for setting a tone color of the musical tone, both of the first and second switches being respectively mounted on the stick; (d) angle detecting means equipped within the stick, the angle detecting means detecting a swinging angle of the stick which is swung by a player; (e) memory means for storing a plurality of predetermined tone colors respectively corresponding to predetermined angle ranges; and (f) control means for controlling the tone pitch of the musical tone based on detected swinging angle of the stick in response to an operating state of the first switch, the control means selecting and setting one of the predetermined tone colors corresponding to the predetermined angle range to which the detected swinging angle of the stick belongs in response to an operating state of the second switch, whereby a musical tone having the selected tone color and also having the tone pitch controlled by the control means is generated.

In a fifth aspect of the invention, there is provided a musical tone control apparatus for controlling a generation of a musical tone in a musical tone generating apparatus comprising: (a) a stick which can be held by a player; (b) a transmitter mounted on an arm of the player who holds the stick by his hand; (c) a receiver for receiving an output signal of the transmitter, the receiver being equipped within the stick; and (d) control means for outputting tone color information corresponding to an output of the receiver to the musical tone generating apparatus to thereby control a tone color of a musical tone to be generated.

In a sixth aspect of the invention, there is provided a musical tone control apparatus for controlling a musical tone to be generated comprising: (a) a stick having a shape which can be held by a player's hand; (b) angle detecting means for detecting a swinging angle of the stick, the angle detecting means being equipped within the stick; (c) transmitter means for transmitting a radio wave having a predetermined frequency in the air, the transmitter means being put on a player's arm; (d) receiver means for receiving the radio wave and outputting frequency data representative of the predetermined frequency, the receiver means being equipped within the stick; and (e) control means for controlling a tone pitch of the musical tone based on the swinging angle of the stick detected by the angle detecting means and also changing a tone color of the musical tone based on the frequency data.

In a seventh aspect of the invention, there is provided a musical tone control apparatus for controlling a generation of a musical tone in a musical tone generating apparatus comprising: (a) a stick which can be held by a player's hand; (b) sensor module which can be freely mounted to and removed from the stick, the sensor module having a sensor for detecting a movement of a player's arm so that the sensor module outputs a detecting result of the sensor and discrimination information for discriminating a kind of the sensor mounted thereto; and (c) control means for generating a control signal based on the detecting result of the sensor and the discrimination information, the musical tone generating apparatus being controlled by the control signal.

In an eighth aspect of the invention, there is provided a musical tone control apparatus for controlling a musical tone to be generated comprising: (a) a stick having a shape which can be held by a player's hand; (b) a sensor module which can be freely mounted to and removed from the stick, the sensor module including at least sensor means for detecting a movement of the player's hand holding the stick so that the sensor module outputs first data representative of a detected movement of the player's hand and second data representative of a kind of the sensor means mounted to the sensor module; and (c) control means for controlling a tone pitch of the musical tone based on the first and second data.

In a ninth aspect of the invention, there is provided a musical tone control apparatus for controlling a generation of a musical tone in a musical tone generating apparatus comprising: (a) a stick being mounted with movement detecting means for detecting a movement of the stick and an operating switch; and (b) control means for controlling the musical tone generating apparatus in correspondence with outputs of the movement detecting means and the switch.

In a tenth aspect of the invention, there is provided a musical tone control apparatus for controlling a musical tone to be generated comprising: (a) two sticks each having a shape which can be held by a player's hand; (b) two switches each mounted on each stick; (c) two acceleration sensors each equipped within the each stick; and (d) control means for controlling a tone color of the musical tone based on operating states of the switches and output levels of the acceleration sensors.

In an eleventh aspect of the invention, there is provided a musical tone control apparatus for controlling a generating of a musical tone in a musical tone generating apparatus comprising: (a) a stick which can be held by a player's hand; (b) a plurality of key-on switches mounted on the stick; (c) detecting means for detecting operating states of the key-on switches; and (d) control means for outputting a key-on control signal corresponding to a detecting result of the detecting means to the musical tone generating apparatus, whereby the key-on control signal controls to start or stop generating the musical tone.

In a twelfth aspect of the invention, there is provided a musical tone control apparatus for controlling a musical tone to be generated comprising: (a) a stick having a shape which can be held by a player's hand; (b) at least two key-on switches each controlling start timing of sounding of the musical tone, the key-on switches being mounted on the stick; (c) angle detector means for detecting a swinging angle of the player's hand holding the stick, the angle detecting means being equipped within the stick; and (d) control means for controlling a tone pitch of the musical tone based on the swinging angle detected by the angle detector means at every time when one of the key-on switches is depressed, the control means stopping generating the musical tone when all of the key-on switches are released.

In a thirteenth aspect of the invention, there is provided a musical tone control apparatus comprising: (a) detecting means for outputting a detection signal corresponding to a movement of a player's hand holding a certain holding portion of a stick means having a desirable length, the detecting means being equipped within the holding portion of the stick means; and (b) means for generating a control signal for controlling a musical tone to be generated in a musical tone generating apparatus based on the detection signal outputted from the detecting means.

In a fourteenth aspect of the invention, there is provided a musical tone control apparatus for controlling a musical tone to be generated comprising: (a) a stick having at least a holding portion which can be held by a player's hand; (b) angle detecting means for detecting a swinging angle of the player's hand holding the stick, the angle detecting means being equipped within the holding portion of the stick; and (c) control means for controlling a tone pitch of the musical tone based on the swinging angle detected by the angle detecting means.

In a fifteenth aspect of the invention, there is provided a musical tone control apparatus comprising: (a) angle detecting means providing a plurality of detecting switches each having a contact which is turned on or off in response to an inclination of a center axis of each detecting switch, the detecting switches being spirally arranged by forming angles among the center axes of the detecting switches so as to cancel an effect of a revolution due to a twisting of a player's wrist which is caused in a period when a player swings his hand holding the angle detecting means around his shoulder joint in his side direction; and (b) control signal generating means for generating a control signal for controlling a musical tone generating apparatus based on an output of the angle detecting means.

In a sixteenth aspect of the invention, there is provided a musical tone control apparatus for controlling a musical tone to be generated comprising: (a) two cylindrical sticks which can be held by player's both hands, a plurality of through holes being formed respectively in each cylindrical stick such that angles are respectively formed between center axes of the through holes and a reference line drawn in a radius direction of an upper or under plane of the cylindrical stick, whereby the center axes of the through holes are spirally arranged with respect to an axis line of the cylindrical stick; (b) angle detecting means consisting of a plurality of detecting switches each inserted into each of the through holes, each detecting switch having a contact which is turned on or off in response to an angle formed between a center axis of the each detecting switch and the plumb line; and (c) control means for controlling a tone pitch of the musical tone in response to outputs of the detecting switches.

In a seventeenth aspect of the invention, there is provided a musical tone control apparatus comprising: (a) holding means equipped with a detector for detecting a movement of a player's hand, said holding means providing a holding portion having a shape which can be held by said player's hand, said shape of said holding portion being determined such that a mounted direction of said detector can be recognized by a sense of said player's hand; and (b) control signal generating means for generating a control signal for controlling a musical tone generating apparatus based on an output of said detector.

In an eighteenth aspect of the invention, there is provided a musical tone control apparatus for controlling a musical tone to be generated comprising: (a) a plurality of sensors each detecting an acceleration applied thereto in a predetermined direction, tone colors being assigned to said sensors respectively; (b) a stick equipped with said sensors, said stick providing a holding portion which is shaped such that a player can recognize a mounted direction of said sensors with ease; (c) control means for controlling a tone volume of said musical tone in response to said acceleration detected by said sensors, one tone color among said tone colors being selected in accordance with a swinging direction of said stick, whereby a musical tone having a selected tone color and also having a tone volume corresponding to said acceleration is to be generated.

In a nineteenth aspect of the invention, there is provided a musical tone control apparatus for controlling a generation of a musical tone in a musical tone generating apparatus comprising: (a) movement detecting means for detecting a movement of a player; (b) a memory; (c) a mode switch for selecting one of a play mode and a write mode; (d) a write switch which is used when a detecting result of said movement detecting means is written in said memory; (e) writing means for writing said detecting result of said movement detecting means into said memory in response to an operating state of said write switch in said write mode; and (f) control means for generating musical tone control data based on said detecting result of said movement detecting means and contents of data stored in said memory in said play mode, said musical tone control data being outputted to said musical tone generating apparatus.

In a twentieth aspect of the invention, there is provided a musical tone control apparatus for controlling a musical tone to be generated comprising: (a) detecting means for detecting a movement of a player's arm; (b) mode selecting means for selecting one of a tone pitch setting mode and a play mode; (c) memory means for storing tone pitches corresponding to detected movement of said player's arm when said tone pitch setting mode is selected; and (d) control means for controlling said musical tone to have a desirable tone pitch among said tone pitches stored in said memory means in response to said movement of said player's arm when said play mode is selected.

BRIEF DESCRIPTION OF THE DRAWINGS

Further objects and advantages of the present invention will be apparent from the following description, reference being made to the accompanying drawings wherein preferred embodiments of the present invention are clearly shown.

In the drawings:

FIG. 18 shows a construction of an angle detector used in the fourth embodiment;

FIG. 19 is a block diagram showing the fourth embodiment;

FIGS. 20(*a*) to 20(*c*) show waveforms of signals and a data format of data essential to the fourth embodiment;

FIG. 21 shows relations between predetermined angle ranges and predetermined tone colors in the fourth embodiment;

FIG. 27 shows an appearance of a rhythm stick used in a seventh embodiment;

FIG. 28 is a block diagram showing the seventh embodiment;

FIG. 29 shows relations between control signals and the tone colors of the musical tone;

FIG. 48 and FIGS. 49A to 49C are drawings for explaining the operations of the fifteenth embodiment.

DESCRIPTION OF THE PREFERRED EMBODIMENTS

Next, description will be given with respect to the preferred embodiments of the present invention.

[A] FIRST EMBODIMENT

Figure 10:
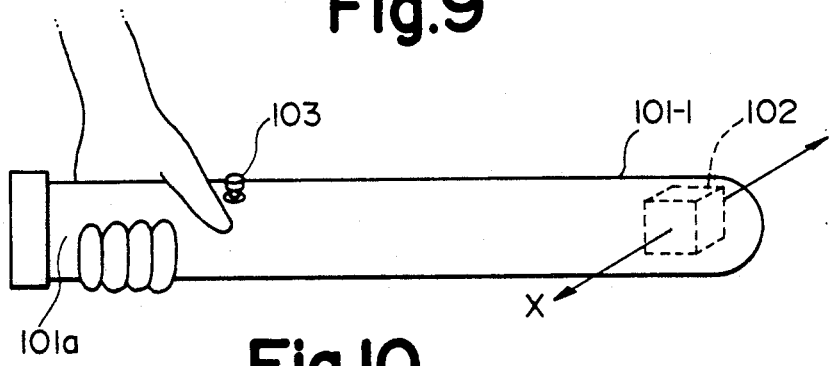
FIG. 10 shows an appearance of a rhythm stick used in a first embodiment of the present invention.

Referring now to the drawings, wherein like reference characters designate like or corresponding parts throughout the several views, FIG. 10 shows an appearance of a rhythm stick 101-1 used in a first embodiment of the musical tone control apparatus according to the present invention. In FIG. 10, the rhythm stick 101-1 is made of synthetic resin, and an acceleration sensor 102 is equipped within a tip end portion of the stick 101-1. This acceleration sensor 102 is made by a piezoelectric element such as a piezo plastic film, hence, this acceleration sensor 102 generates a signal Sg the level of which corresponds to the acceleration applied to the stick 101-1 in a direction X. As the swinging speed of the stick 101-1 becomes faster, the level of the signal Sg becomes higher.

Figure 11:
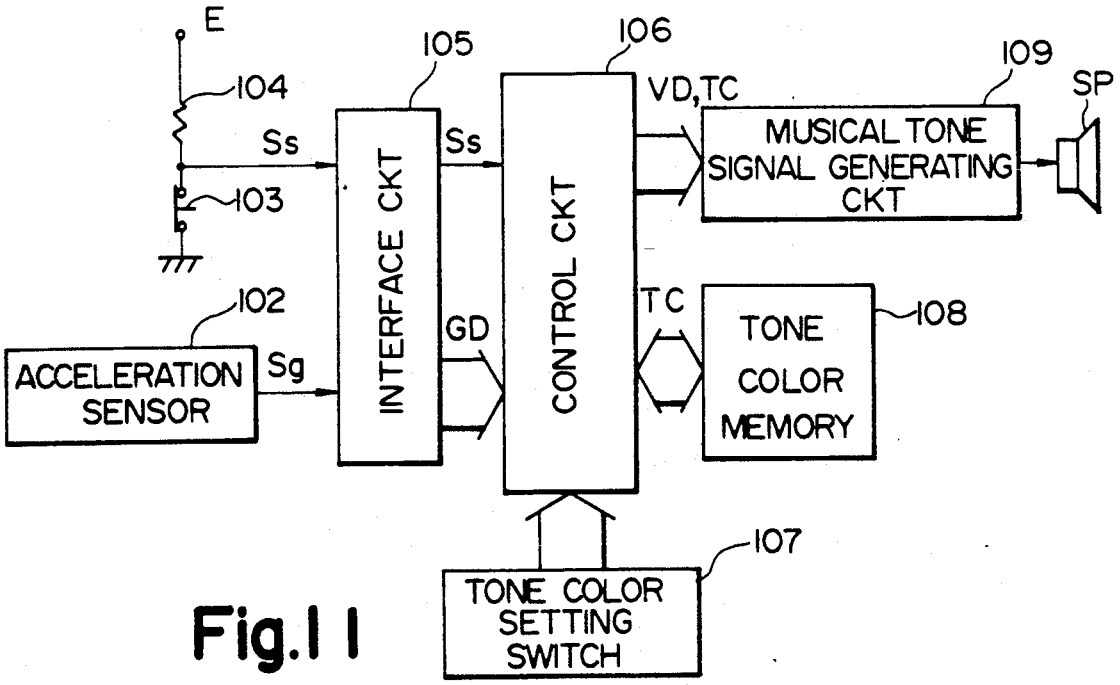
FIG. 11 is a block diagram showing the first embodiment.

Meanwhile, a push-button switch 103 is mounted at a position where the thumb of the player holding a holding portion 101*a* of the stick 101-1 can reach. As shown in FIG. 11, one terminal of the switch 103 is connected to a power source E via a resister 104, and another terminal of the switch 103 is grounded to GND. While the player does not depress the switch 103, a signal Ss having a low ("L") level is supplied to an interface circuit 105. On the contrary, while the player depresses the switch 103, the signal Ss having a high ("H") level is supplied to the interface circuit 105. In addition, the acceleration sensor 102 outputs the signal Sg to the interface circuit 105. The interface circuit 105 inputs the signal Ss from the switch 103 and directly outputs such signal Ss to a control circuit 106. In addition, the interface circuit 105 generates digital data GD the value of which represents the level of the signal Sg, and such digital data GD are outputted to the control circuit 106. The control circuit 106 is constructed by a central processing unit (CPU) and the like. This control circuit 106 is designed to control a generation of the musical tone, whereas detailed description thereof will be described later. In FIG. 11, 107 designates a tone color setting switch which is used for setting the tone color, 108 designates a tone color memory for pre-storing a tone color code TC, and 109 designates a musical tone signal generating circuit. The control circuit 106 outputs tone volume data VD to the musical tone signal generating circuit 109 wherein a musical tone signal having a tone volume corresponding to the tone volume data VD is generated. Hence, the musical tone signal generating circuit 109 outputs the above-mentioned musical tone signal to thereby drive the speaker SP.

Next, description will be given with respect to an operation of the above-mentioned first embodiment. When the power is applied to the first embodiment as shown in FIG. 11, the player operates the tone color setting switch 107 so as to sequentially set a plurality of tone colors. Based on the output of the tone color setting switch 107, the control circuit 106 detects the set tone colors and sequentially writes the tone color codes TC representative of such set tone colors in a head address (i.e., a zero-address) and the following addresses of the tone color memory 108. After completing such write-in operation of the tone color memory 108, the tone color code TC0 written at the zero-address of the tone color memory 108 is transferred to the musical tone signal generating circuit 109. Thus, a first tone color initially inputted by using the tone color setting, switch 107 is set in the musical tone signal generating circuit 109. In this state, when the player holds and swings the stick 101-1 in the direction X without depressing the switch 103, the interface circuit 105 outputs the signal Ss having the "L" level and the digital data GD to the control circuit 106. This control circuit 106 is designed to input the signal Ss and the digital data GD at every predetermined constant time. Therefore, the control circuit 106 generates and outputs the tone volume data VD corresponding to the digital data GD to the musical tone signal generating circuit 109. Hence, this musical tone signal generating circuit 109 generates and outputs the musical tone having the tone volume corresponding to the inputted tone volume data VD to thereby drive the speaker SP.

Next, when the player depresses the switch 103, the signal Ss having the "H" level is inputted to the control circuit 106. Hence, the control circuit 106 reads a first tone color code TC1 from a first-address of the tone color memory 108 to thereby set such first tone color code TC1 in the musical tone signal generating circuit 109. At this state, when the player swings the stick 101-1 in the direction X, the speaker SP generates a musical tone having a newly set first tone color and also having a tone volume corresponding to the acceleration of the swinging stick 101-1. Next, when the player depresses the switch 103 again, a second tone color code TC2 written at a second-address of the tone color memory 108 is set in the musical tone signal generating circuit 109. Further, when the player depresses the switch 103 again, a third tone color code TC3 written at a third-address of the tone color memory 108 is set in the musical tone signal generating circuit 109. As described heretofore, the first embodiment sequentially sets the tone colors written in the tone color memory 108 in the musical tone signal generating circuit 109.

Incidentally, the above-mentioned first embodiment pre-stores the tone color codes TC in the tone color memory 108 by using the tone color setting switch 107 and reads the desirable tone color code TC from the tone color memory 108 when the player selectively changes the tone color of the musical tone to be generated. Instead, it is possible to provide a read only memory (ROM) for pre-storing the tone color codes TC with the first embodiment and read the desirable tone color code TC from such ROM.

[B] SECOND EMBODIMENT

Figure 12:
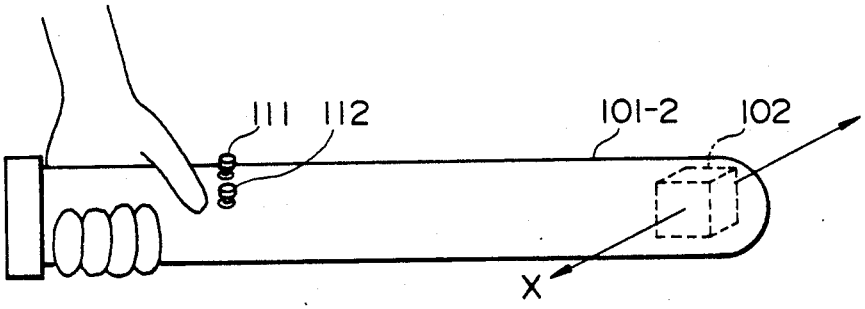
FIG. 12 shows an appearance of a rhythm stick used in a second embodiment of the present invention.
Figure 13:
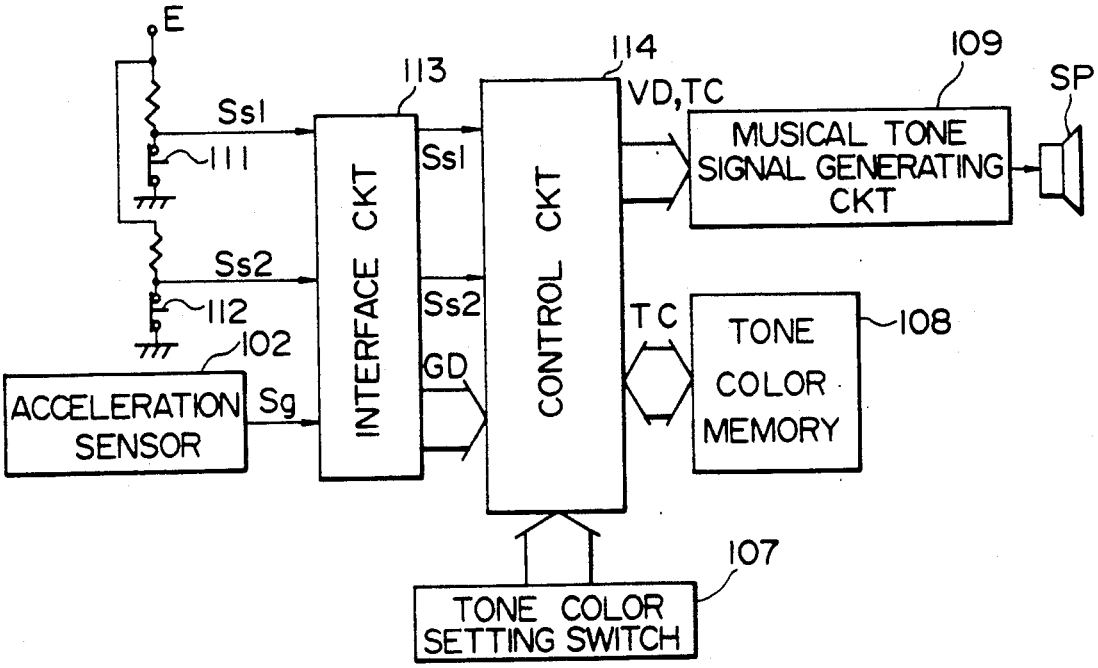
FIG. 13 is a block diagram showing the second embodiment.
Figure 14:
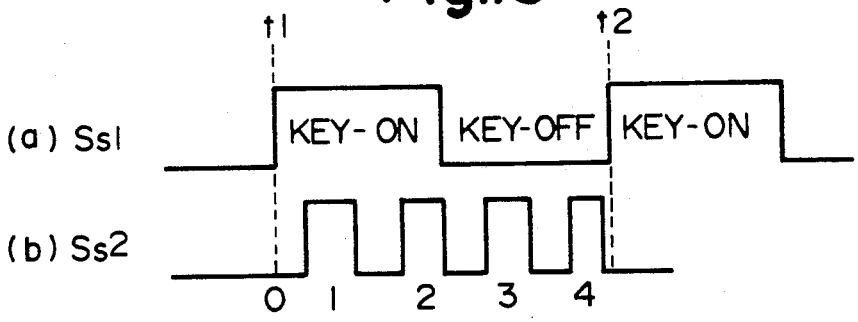
FIGS. 14(*a*) and 14(*b*) show waveforms of signals essential to the second embodiment.

Next, description will be given with respect to a second embodiment of the musical tone control apparatus in conjunction with FIGS. 12 to 14. The parts identical to those used in the first embodiment will be designated by the same numerals in the second embodiment, hence, description thereof will be omitted. In addition, the tone color memory 108 (shown in FIG. 13) according to the second embodiment have already pre-stored the tone color codes TC. FIG. 12 shows an appearance of the rhythm stick 101-2 used in the second embodiment. This second embodiment is characterized by using two push-button switches 111 and 112 as shown in FIG. 12. These switches 111 and 112 output respective signals Ss1 and Ss2 (as shown in FIGS. 14(*a*) and 14(*b*)) to an interface circuit 113. This interface circuit 113 directly passes the signals Ss1 and Ss2 to a control circuit 114. Similar to the interface circuit 105 shown in FIG. 11, the interface circuit 113 generates the digital data GD to the control circuit 114 based on the inputted signal Sg from the acceleration sensor 102, and such digital data GD are outputted to the control circuit 114. This control circuit 114 is designed to input the signals Ss1 and Ss2 and the digital data GD from the interface circuit 113 by every predetermined constant time. When the signal Ss1 has the "H" level, the control circuit 114 generates and outputs the tone volume data VD corresponding to the digital data GD to the musical tone signal generating circuit 109. Thus, the speaker SP generates the musical tone as described before.

Next, based on the signals Ss1 and Ss2, the control circuit 114 counts the times for depressing the switches 112 between a time when the switch 111 is firstly depressed and a next time when the switch 111 is secondly depressed. Based on such counted times, the control circuit 114 selectively changes the tone color of the musical tone to be generated. More specifically, in the case where the levels of the signals Ss1 and Ss2 vary as shown in FIGS. 14(*a*) and 14(*b*), the control circuit 114 counts the times by which the level of the signal Ss2 becomes the "H" level between a first leading edge timing t1 and a second leading edge timing t2 of the signal Ss1. Next, the control circuit 114 reads a fourth tone color code TC4 from a fourth-address of the tone color memory 108 in accordance with the counting result "4" obtained by the above-mentioned counting operation. This fourth tone color code TC4 is set in the musical tone signal generating circuit 109. As described heretofore, it is possible to freely set the tone color of the musical tone to be generated in accordance with the times for depressing the switch 112 in the second embodiment.

[C] THIRD EMBODIMENT

Figure 15:
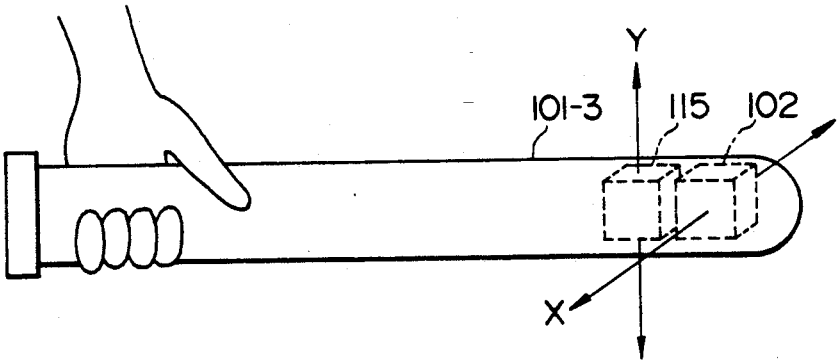
FIG. 15 shows an appearance of a rhythm stick used in a third embodiment of the present invention.
Figure 16:
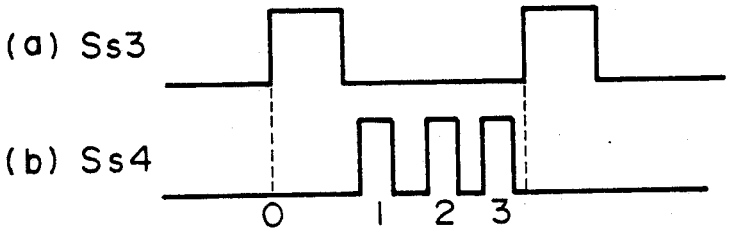
FIGS. 16(*a*) and 16(*b*) show waveforms of signals essential to the third embodiment.

Next, description will be given with respect to a third embodiment of the musical tone control apparatus in conjunction with FIGS. 15 and 16. In this third embodiment, parts identical to those in the first and second embodiments will be designated by the same numerals, hence, description thereof will be omitted. FIG. 15 shows an appearance of the rhythm stick 101-3 used in the third embodiment of the invention. In FIG. 15, 115 designates an acceleration sensor having a function similar to that of the acceleration sensor 102 used in the first and second embodiments. More specifically, the acceleration sensor 115 generates a signal Sg1 when the player swings the stick 101-3 in a direction Y perpendicular to the direction X as shown in FIG. 15. Both of the output signals Sg and Sg1 of the acceleration sensors 102 and 115 are supplied to the control circuit 114 (shown in FIG. 13) via an interface circuit (not shown).

The above-mentioned interface circuit inputs the signals Sg and Sg1 from the acceleration sensors 102 and 115 at first. Secondly, this interface circuit generates the digital data GD based on the signal Sg as described before in conjunction with FIG. 13, and such digital data GD are outputted to the control circuit 114. Thirdly, this interface circuit compares the levels of the signals Sg and Sg1 respectively with a predetermined level so as to generate signals Ss3 and Ss4. More specifically, when the level of the signal Sg is higher than the predetermined level, the level of the signal Ss3 becomes identical to the "H" level. On the other hand, when the level of the signal Sg is not higher than the predetermined level, the level of the signal Ss3 becomes identical to the "L" level. Similarly, the level of the signal Ss4 varies between the "H" level and the "L" level based on the comparing result between the level of the signal Sg1 and the predetermined level. Thus, the levels of the signals Ss3 and Ss4 will be varied as shown in FIGS. 16(*a*) and 16(*b*), for example. The control circuit 114 inputs these signals Ss3 and Ss4 and the digital data GD. Instead of the signals Ss1 and Ss2 shown in FIG. 13, the control circuit 114 uses the signals Ss3 and Ss4 to thereby operate as described before in the second embodiment.

As described heretofore, the third embodiment generates a musical tone having a predetermined tone color and also having a tone volume corresponding to the swinging action (i.e., the swinging acceleration) of the stick 101-3 at every time when the player swings the stick 101-3 in the direction X by a certain swinging acceleration which is larger than a predetermined swinging acceleration. In addition, the third embodiment can change the tone color of the musical tone in response to the times for swinging the stick 101-3 in the direction Y by such certain swinging acceleration while the player swings the stick 101-3 by two times by such certain swinging acceleration.

Incidentally, the third embodiment uses the signals Ss3 and Ss4 based on the output signals Sg and Sg1 of the acceleration sensors 102 and 115 instead of the signals Ss1 and Ss2 in the second embodiment, whereby the third embodiment selectively changes the tone color of the musical tone as described before in the second embodiment. However, it is possible to modify the constitution of the third embodiment as shown in FIG. 11 and use the signal Ss4 instead of the signal Ss. In this case, the third embodiment can change the tone color of the musical tone as described before in conjunction with FIG. 11 of the first embodiment.

[D] FOURTH EMBODIMENT

Figure 17:
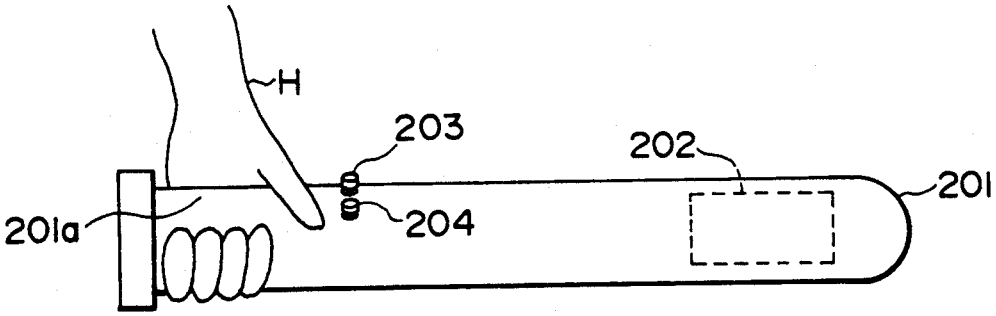
FIG. 17 shows an appearance of a rhythm stick used in a fourth embodiment of the present invention.

Next, description will be given with respect to a fourth embodiment of the present invention in conjunction with FIGS. 17 to 20. In FIG. 17, a holding portion 201*a* is formed at one end portion of a rhythm stick 201 having a cylindrical shape, and an angle detector 202 is equipped within another end portion of the stick 201. In addition, push-button switches 203 and 204 are mounted at respective positions where the thumb of the player holding the holding portion 201*a* can reach. Similar to the angle detector 2 shown in FIG. 2, the angle detector 202 shown in FIG. 18 provides five mercury switches D1 to D5 which are radially disposed and fixed on a base plate 202*a* by every 30 degrees. More specifically, the angles formed between the center lines of the mercury switches D1 to D5 and a reference line G are determined as 30 degrees, 60 degrees, 90 degrees, 120 degrees and 150 degrees respectively. Each of the mercury switches D1 to D5 provides two electrodes such as D1*a* and D1*b*; D2*a* and D2*b*; D3*a* and D3*b*; D4*a* and D4*b*; D5*a* and D5*b*. In response to the angle formed between the reference line G and the plumb line, one or some of the mercury switches D1 to D5 will be turned on.

In FIG. 19, respective first terminals of the mercury switches D1 to D5 within the angle detector 202 are connected to an interface circuit 205. In addition, a constant voltage +V is applied to first terminals of the switches 203 and 204 and the first terminals of the mercury switches D1 to D5 via respective resistors R. On the other hand, second terminals of the switches 203 and 204 and second terminals of the mercury switches D1 to D5 are all grounded to (GND). Based on outputs of the mercury switches D1 to D5, the interface circuit 205 detects an angle formed between the plumb line and the player's arm H. Hence, the interface circuit 205 sequentially outputs angle data KD to a control circuit 206 as the detection result thereof. In addition, the interface circuit 205 inputs operating states of the switches 203 and 204 so as to output signals S1 and S2. More specifically, levels of the signals S1 and S2 turn up to the "H" levels when the player depresses the switches 203 and 204. On the contrary, the levels of the signals S1 and S2 turn down to the "L" levels when the player releases the switches 203 and 204. Thus, the signals S1 and S2 as shown in FIGS. 20(*a*) and 20(*c*) can be obtained, for example. These signals S1 and S2 are supplied to the control circuit 206. This control circuit 206 is constructed by the CPU and the like so as to control the generation of the musical tone, and detailed description thereof will be given later.

Next, the control circuit 206 outputs the tone color code TC and a tone pitch code KC to a musical tone signal generating circuit 207 wherein a musical tone signal having a tone color corresponding to the tone color code TC and also having a tone pitch corresponding to the tone pitch code KC is generated. This musical tone signal drives the speaker SP. Meanwhile, a ROM is used for tone color memory 208, and tone color codes TC corresponding to predetermined tone colors Piano1, Piano2, Harp, Elepiano and Trampet shown in FIG. 21 are stored respectively in zero-address to fourth-address of the tone color memory 208.

Next, description will be given with respect to operations of the fourth embodiment of the present invention. First, description will be given with respect to an operation for setting the tone color. When the player holds the stick 201, swings up his arm by a predetermined angle and then depresses the switch 204, the tone color of the musical tone to be generated must be changed in response to the swinging angle of his arm at this time. More specifically, angle ranges A1 to A5 shown in FIG. 21 respectively corresponds to the tone colors Piano1 to Trampet, and the swinging angle of the player's arm belongs to one of the angle ranges A1 to A5, whereby one of the tone colors Piano1 to Trampet is selected. More concretely, the control circuit 206 detects that the switch 204 is depressed at a leading edge timing t11 of the signal S2 shown in FIG. 20(*c*) and then checks the angle data KD outputted from the interface circuit 205. If the control circuit 206 detects that the swinging angle of the player's arm belongs to the angle range A3 at this time as shown in FIG. 20(*b*), the control circuit 206 reads the tone color code TC representative of the tone color Harp from the second-address of the tone color memory 208 based on the table shown in FIG. 21. Such tone color code TC is transferred to the musical tone signal generating circuit 207 wherein the tone color Harp is set therein.

Next, description will be given with respect to an operation for generating the musical tone. When the player swings up the stick 201 while he depresses the switch 203, the signal S1 turns to a signal having a "1" level (hereinafter, referred to as a "1" signal). Hence, the interface circuit 205 outputs such "1" signal to the control circuit 206, whereby the control circuit 206 generates and outputs the tone pitch code KC corresponding to the angle data KD to the musical tone signal generating circuit 207. Hence, the musical tone signal generating circuit 207 generates a musical tone signal having a tone pitch corresponding to the tone pitch code KC. This musical tone signal drives the speaker SP. Thus, the speaker SP generates a musical tone having the tone pitch corresponding to the swinging angle of the player's arm and also having the tone color which has been set as described before.

Next, description will be given with respect to an operation for changing the tone color in the control circuit 206 in a specific case where the switch 204 is depressed while the switch 203 is depressed. In this case, the control circuit 206 does not change the tone color at a leading edge timing t12 of the signal S2 (shown in FIG. 20(*c*)) when the switch 204 is depressed, but the control circuit 206 changes the tone color at a trailing edge timing t13 of the signal S1 (shown in FIG. 20(*a*)) when the switch 203 is released. At this timing t13, the control circuit 206 detects that the swinging angle of the player's arm belongs to the angle range A1 based on the angle data KD as shown in FIG. 20(*b*). Then, the control circuit 206 reads the tone color code TC representative of the tone color Piano1 from the zero-address of the tone color memory 208, whereby the tone color Piano1 is set in the musical tone signal generating circuit 207.

Incidentally, the fourth embodiment employs the angle detector 202 as angle detecting means. However, this angle detecting means is not limited to the angle detector 202. In addition, the fourth embodiment controls the tone pitch and the tone color of the musical tone to be generated. However, it is possible to control the tone volume instead of the tone pitch in the fourth embodiment.

[E] FIFTH EMBODIMENT

Figure 5:
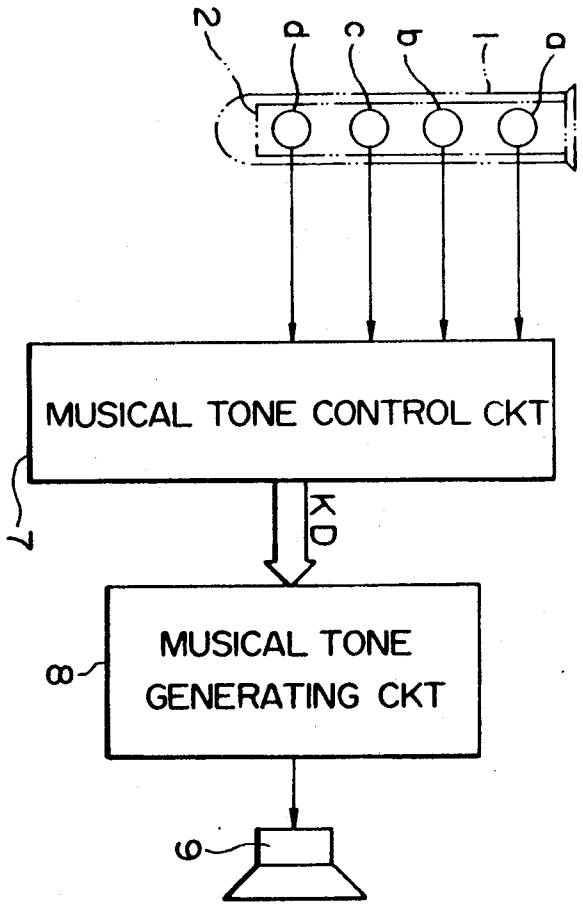
FIG. 5 is a block diagram showing the first example of the proposed musical tone control apparatus.
Figure 6:
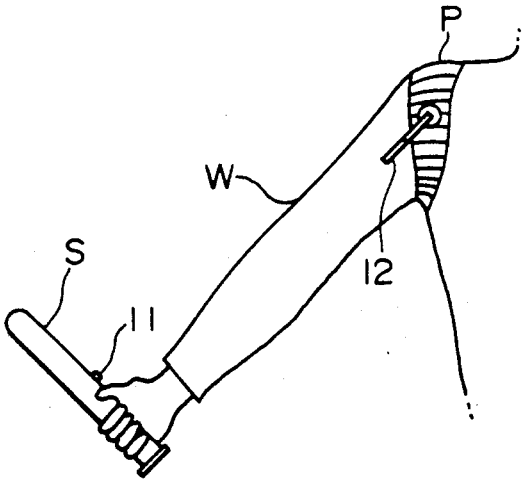
FIG. 6 shows an appearance of the second example of the proposed musical tone control apparatus.
Figure 7:
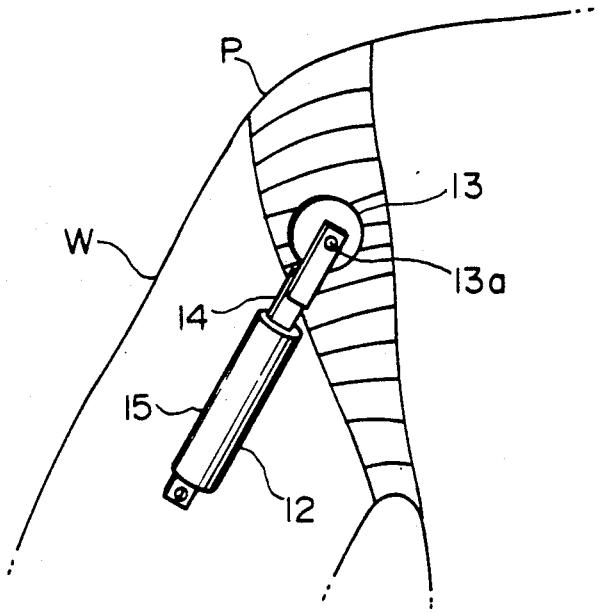
FIG. 7 shows an essential part of the second example of the proposed musical tone control apparatus shown in FIG. 6.
Figure 8:
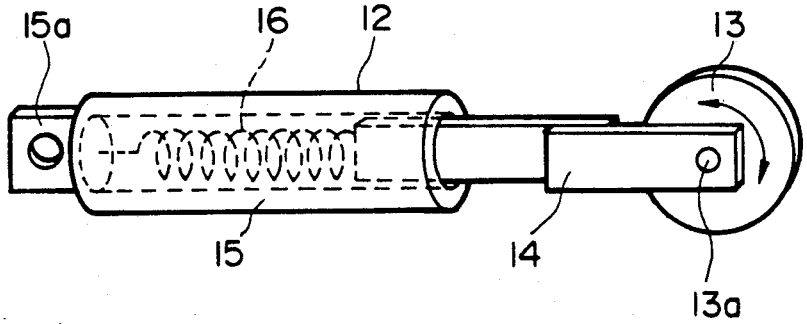
FIG. 8 shows an appearance of the angle detector used in the second example of the proposed musical tone control apparatus.
Figure 22:
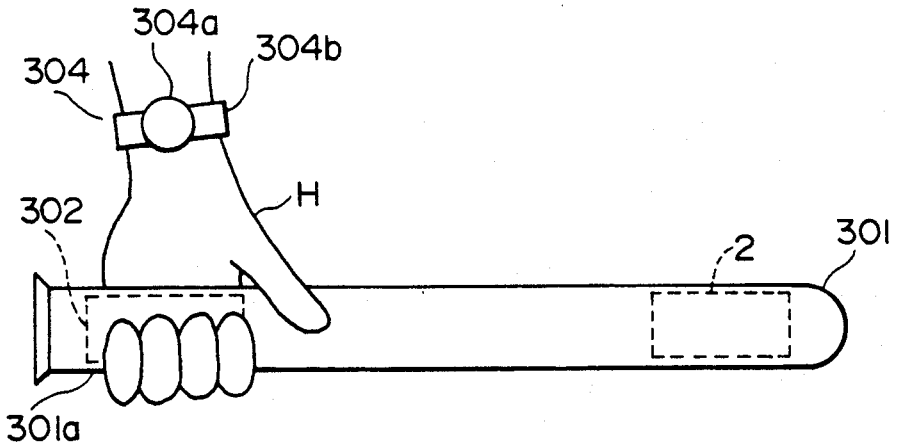
FIG. 22 shows an appearance of a rhythm stick used in a fifth embodiment.
Figure 23:
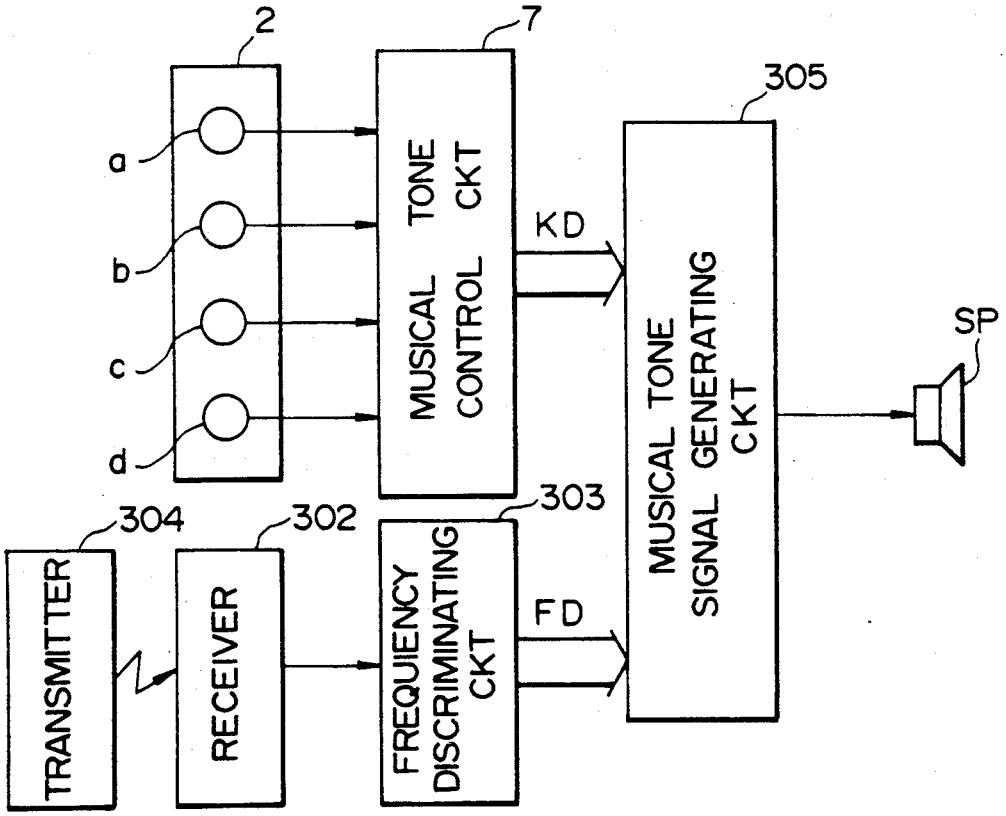
FIG. 23 is a block diagram showing the fifth embodiment.

Next, description will be given with respect to a fifth embodiment of the present invention in conjunction with FIGS. 22 and 23. The angle detector 2 providing mercury switches "a" to "d" and the musical tone control circuit 7 shown in FIG. 5 are applied to this fifth embodiment as shown in FIG. 23, hence, description thereof will be skipped. FIG. 22 shows an appearance of a rhythm stick 301 used in the fifth embodiment. In FIG. 22, a receiver 302 is equipped within a holding portion 301*a* of the stick 301. This receiver 302 is constructed by a coil and the like so as to receive a high frequency signal transmitted in the air. Such received high frequency signal is outputted to a frequency discriminating circuit 303 shown in FIG. 23. As shown in FIG. 22, the holding portion 301*a* of the stick 301 is held by the player's hand H. The player puts a watch-type transmitter 304 on his wrist. This transmitter 304 is constructed by a transmitting portion 304*a* for transmitting a high frequency wave having a predetermined frequency in the air and a band 304*b* mounted with the transmitting portion 304*a*. The high frequency wave transmitted from the transmitter 304 is received by the receiver 302.

As described before in conjunction with FIG. 5, the musical tone control circuit 7 detects the angle of the angle detector 2 against the plumb line based on the on/off states of the mercury switches "a" to "d". In other words, the musical tone control circuit 7 detects the angle of the player's arm against the plumb line. Hence, the musical tone control circuit 7 sequentially outputs the angle data KD as the detecting result thereof to a musical tone signal generating circuit 305.

Meanwhile, the frequency discriminating circuit 303 includes a plurality of filter circuits (not shown) in order to discriminate the frequency of the output signal of the receiver 302 from other frequencies. Hence, the frequency discriminating circuit 303 generates and sequentially outputs frequency data FD as the discriminating result thereof to the musical tone signal generating circuit 305. This musical tone signal generating circuit 305 inputs the angle data KD and the frequency data FD so as to generate a musical tone signal having a tone pitch corresponding to the angle data KD and also having a tone color corresponding to the frequency data FD. Such musical tone signal is supplied to the speaker SP. Thus, the speaker SP generates a musical tone having a tone pitch corresponding to the swinging angle of the player's arm and also having a tone color corresponding to a transmitting frequency of the transmitter 304. For example, each of the players can put on the transmitter 304 the transmitting frequency of which is different from each other, and the same stick 301 can be relayed among the players. In this case, the tone color of the musical tone to be generated will be changed in response to the player who receives the stick 301.

The above-mentioned fifth embodiment transmits the high frequency signal between the transmitter 304 and the receiver 302 by wireless, and the tone color of the musical tone is changed by use of a frequency difference. However, it is possible to use a sound wave instead of the high frequency wave in the fifth embodiment. In addition, it is possible to change the tone color by use of a level difference instead of the frequency difference. Further, the fifth embodiment controls the tone pitch of the musical tone in response to the angle data KD. However, it is possible to control the tone volume of the musical tone in response to the angle data KD.

[F] SIXTH EMBODIMENT

Figure 24:
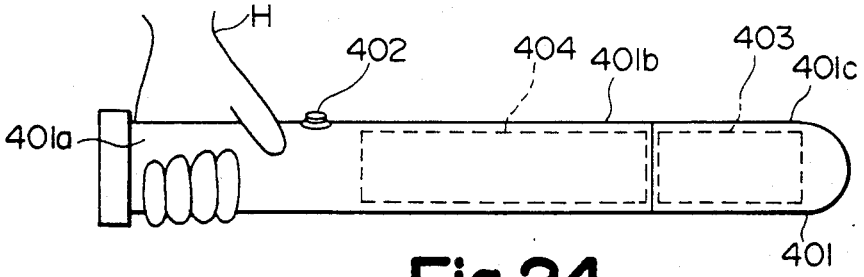
FIG. 24 shows an appearance of a rhythm stick used in a sixth embodiment.
Figure 25:
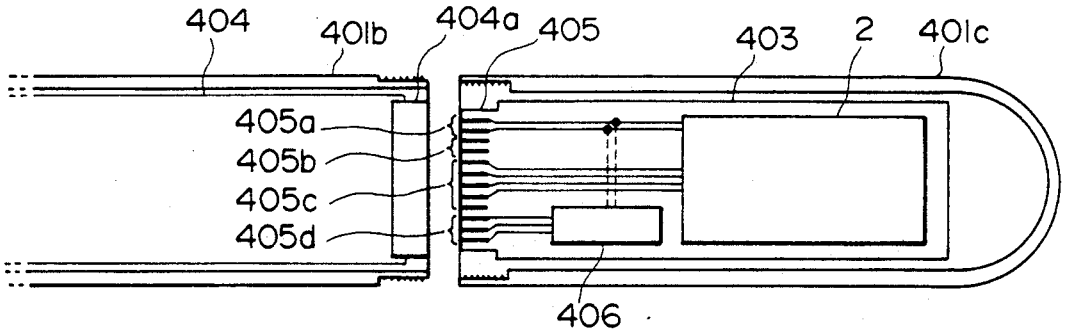
FIG. 25 shows a detailed construction of the rhythm stick shown in FIG. 24.
Figure 26:
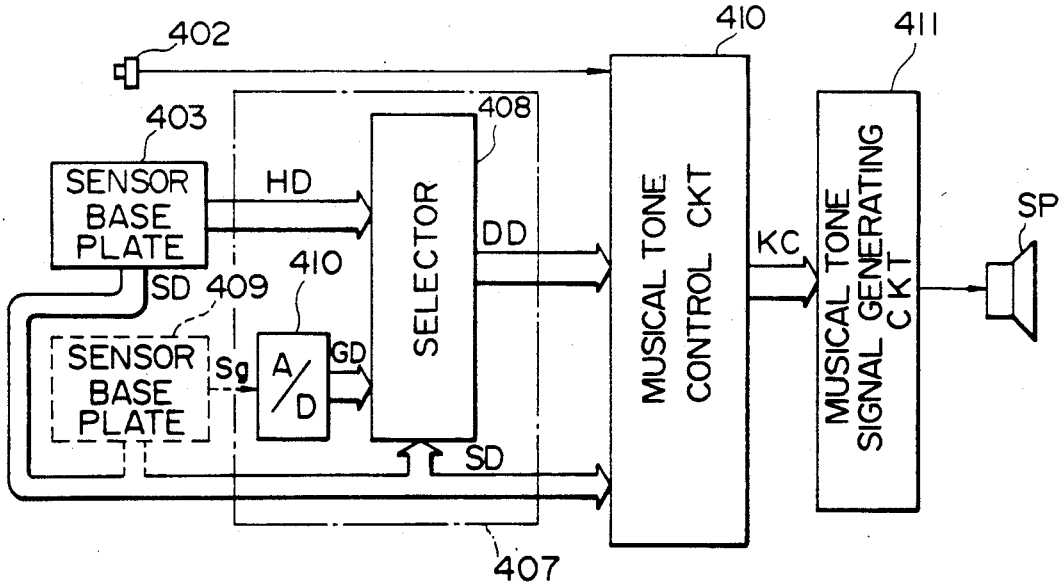
FIG. 26 is a block diagram showing the sixth embodiment.

Next, description will be given with respect to a sixth embodiment of the present invention in conjunction with FIGS. 24 to 26. FIG. 24 shows an appearance of a rhythm stick 401 which is used in the sixth embodiment. In FIG. 24, a push-button switch 402 is mounted around a holding portion 401*a* of the stick 401, and this switch 402 is connected to a musical tone control apparatus 410 which will be described later. As shown in FIG. 25, a tip edge portion 401*c* of the stick 401 is shaped like a long and slender cap, and this tip edge portion 401*c* is connected to a body portion 401*b* of the stick 401 by use of a screw. In addition, a sensor base plate 403 is mounted within the tip edge portion 401*c*, and an interface base plate 404 is mounted within the body portion 401*b*. Further, a card edge 405 of the sensor base plate 403 is inserted into a connector 404*a* which is mounted to the interface base plate 404. As shown in FIG. 25, a power terminal 405*a*, an analog output terminal 405*b* for outputting an analog signal, a digital output terminal 405*c* for outputting a digital signal and a discrimination data output terminal 405*d* for outputting discrimination data SD (which will be described later) are formed on a surface of the card edge 405. On the other hand, the angle detector 2 (shown in FIG. 2) and a discrimination sign generator 406 are mounted on the sensor base plate 403. In the sixth embodiment, the angle detector 2 is connected in order to output data HD representing the on/off states of the mercury switches "a" to "d".

Meanwhile, the discrimination sign generator 406 is constructed by three dip switches so as to output discrimination data SD for discriminating the kind of the sensor mounted to the sensor base plate 403. In this case, the discrimination data SD represent the angle detector 2. The output data HD of the angle detector 2 are supplied to the digital output terminal 405*c*, and the discrimination data SD of the discrimination sign generator 406 are supplied to the discrimination data output terminal 405*d*. These data HD and SD are supplied to a selector 408 within an interface circuit 407 (shown in FIG. 26) via the connector 404*a*.

In the above-mentioned sixth embodiment, the sensor base plate 403 mounted with the angle detector 2 is inserted into the connector 404*a*. However, it is possible to modify the sixth embodiment such that the sensor base plate 403 mounted with an acceleration sensor is inserted into the connector as shown by dotted line in FIG. 26. In this case, the angle sensor is constructed by the piezoelectric element such as the piezo plastic film. When an acceleration is applied to this angle sensor in a predetermined direction, this angle sensor generates a signal Sg having a level corresponding to the acceleration applied thereto. This signal Sg is supplied to an analog-to-digital (A/D) converter 410 within the interface circuit 407, and the discrimination data SD (representative of the acceleration sensor) are supplied to the selector 408 via the digital output terminal 405*c*. The A/D converter 410 converts the level of the signal Sg into digital data GD, and the digital data GD are supplied to the selector 408. This selector 408 selects one of the two data HD and GD in response to the discrimination data SD, and the selected data are supplied to a musical tone control circuit 410 as data DD. This musical tone control circuit 410 is designed to investigate an operating state of the switch 402. When the musical tone control circuit 410 detects that the switch 402 is at the "on" state, the musical tone control circuit 410 judges which sensor outputs the data DD based on the discrimination data SD. Then, the musical tone control circuit 410 generates the tone pitch code KC based on the judgment result thereof and the data DD, and this tone pitch code KC is supplied to a musical tone signal generating circuit 411. Thus, the speaker SP generates a musical tone having a tone pitch corresponding to a swinging force of the player's arm.

The above-mentioned sixth embodiment provides the stick 401 with the sensor base plate 403 or 409. However, the sensor base plate which can be mounted to the stick 401 is not limited to such plates 403 and 409. In addition, the sixth embodiment provides the sensor base plate 403 with the angle detector 2 and the discrimination sign generator 406. However, parts which can be mounted on the sensor base plate 403 are not limited to such angle detector 2 and discrimination sign generator 406. Further, the sixth embodiment provides the sensor base plate 403 with the card edge 405. However, the part which can take the output of the sensor base plate 403 is not limited to such card edge 405.

Meanwhile, the sixth embodiment provides the stick 401 with the sensor base plate 403 or 409. However, the part which can mount the sensor to the stick 401 is not limited to such plates 403 and 409. In addition, the sixth embodiment provides the interface circuit 407 on the interface base plate 404 of the stick 401. However, the interface circuit 407 is not necessarily provided on the interface base plate 404. Further, the sixth embodiment controls the tone pitch of the musical tone in response to the output data DD of the selector 408. Instead, it is possible to control the tone color, the tone volume and the like of the musical tone in response to the output data DD.

As described heretofore, the musical tone control apparatus according to the sixth embodiment can provide one stick with several kinds of sensors. Hence, it is possible to select a suitable sensor in response to the movement of the player's arm. In other words, it is possible to generate a musical tone in response to several kinds of movements of the player's arm by use of one stick only.

[G] SEVENTH EMBODIMENT

Next, description will be given with respect to a seventh embodiment of the present invention in conjunction with FIGS. 27 to 29. FIG. 27 shows an appearance of a rhythm stick 501R used in the seventh embodiment. This stick 501R has a cylindrical shape which is held by a player's right hand, and a push-button switch 502R is mounted near a holding portion 501*a* of the stick 501R. In addition, an acceleration sensor 503R is equipped within a tip edge portion of the stick 501. This acceleration sensor 503R is constructed by the piezoelectric element such as the piezo plastic film so that the acceleration sensor 503R generates a signal having a level corresponding to an acceleration in a direction R when the stick 501R is swung by the player in the direction R. Meanwhile, the player holds a stick 501L (not shown) having a construction similar to that of the stick 501R by his left hand.

Next, outputs of the switch 502R and the acceleration sensor 503R provided within the stick 501R are supplied to a control data generating circuit 504. Similarly, outputs of a switch 502L and an acceleration sensor 503L provided within the stick 501L are also supplied to the control data generating circuit 504. The control data generating circuit 504 checks on operating states of the switches 502R and 502L. More specifically, the control data generating circuit 504 outputs the "1" signals as signals SR and SL when the switches 502R and 502L are depressed. On the other hand, the control data generating circuit 504 outputs the "0" signals as the signals SR and SL when the switches 502R and 502L are released. Such signals SR and SL are supplied to a musical tone signal generating circuit 505. In addition, the control data generating circuit 504 compares the output level of the acceleration sensor 503R with a constant voltage so as to output a signal KR. More specifically, the "1" signal is outputted as the signal KR when the above output level is higher than the constant voltage, whereas the "0" signal is outputted as the signal KR when the above output level is lower than the constant voltage. Similarly, the control data generating circuit 504 compares the output level of the acceleration sensor 503L with the constant voltage so as to output a signal KL the level of which is determined based on the comparing result thereof. The musical tone signal generating circuit 505 generates a musical tone signal based on the above-mentioned signals SR, SL, KR and KL. This musical tone signal drives the speaker SP.

Next, description will be given with respect to an operation of the musical tone signal generating circuit 505 in conjunction with FIG. 29. In FIG. 29, T1 to T7 designate the tone colors of the musical tone. When the signal KR is identical to the "1" signal, the musical tone signal generating circuit 505 generates a musical tone signal having one of the tone colors T1, T3, T5 and T7. In addition, when the signal KL is identical to the "1" signal, the musical tone signal generating circuit 505 generates a musical tone signal having one of the tone colors T2, T4, T6 and T7. Further, when both of the signals KR and KL are identical to the "0" signals, the circuit 505 does not generate the musical tone signal at all. Furthermore, when both of the signals KR and KL are identical to the "1" signals, the circuit 505 generates a musical tone signal having both of tone colors respectively corresponding to the signals KR and KL.

For example, in the case where the signals SR and SL are respectively identical to the "0" and "1" signals and the signals KR and KL are respectively identical to the "1" and "0" signals, the musical tone signal generating circuit 505 generates and outputs a musical tone signal having the tone color T3 to the speaker SP. In the case where the signals SR and SL are respectively identical to the "1" and "0" signals and both of the signals KR and KL are identical to the "1" signals, the circuit 505 generates and outputs a musical tone signal having the tone pitches T5 and T6 to the speaker SP. According to the seventh embodiment as described heretofore, the player can hold the sticks 501R and 501L by his right and left hands and can also operate the switches 502R and 502L by his fingers. Therefore, when the player swings the sticks 501R and 501L by a speed more than a predetermined constant speed, the speaker SP generates the musical tone having the arbitrary tone colors as shown in FIG. 29.

Incidentally, the seventh embodiment is designed to generate the musical tone having the tone color T7 even when the player swings one of the sticks 501R and 501L in the case where both of the switches 502R and 502L are depressed. Hence, it becomes possible to generate the musical tone having the same tone color with a high speed by moving the player's both hands. In other words, it becomes possible to obtain a fill-in of a performance method in the seventh embodiment. For example, it becomes possible to perform a tune having high-speed notes such as sixteenth notes used for continuously generating tam tones.

The above-mentioned seventh embodiment detects the movements of the sticks 501R and 501L by use of the acceleration sensors 503R and 503L. However, the present invention is not limited to that, and it is possible to use other sensors so as to detect the movements of the sticks 501R and 501L.

In addition, the seventh embodiment controls the tone color of the musical tone in response to the operating states of the switches 502R and 502L and the acceleration sensors 503R and 503L. Instead, it is possible to control the tone volume and the tone pitch of the musical tone in the seventh embodiment.

[H] EIGHTH EMBODIMENT

Figure 30:
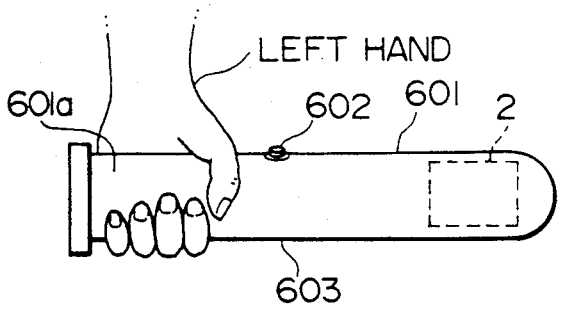
FIG. 30 shows an appearance of a rhythm stick used in eighth and ninth embodiments.
Figure 31:
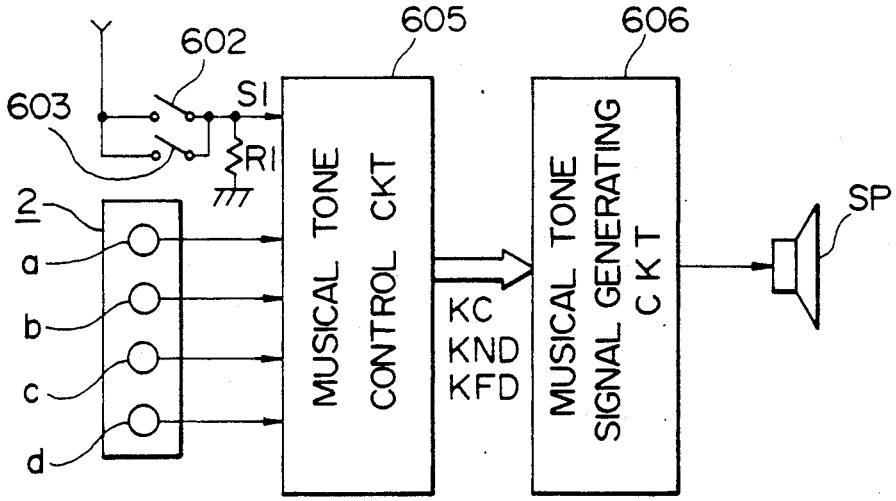
FIG. 31 is a block diagram showing the eighth embodiment.
Figure 32:
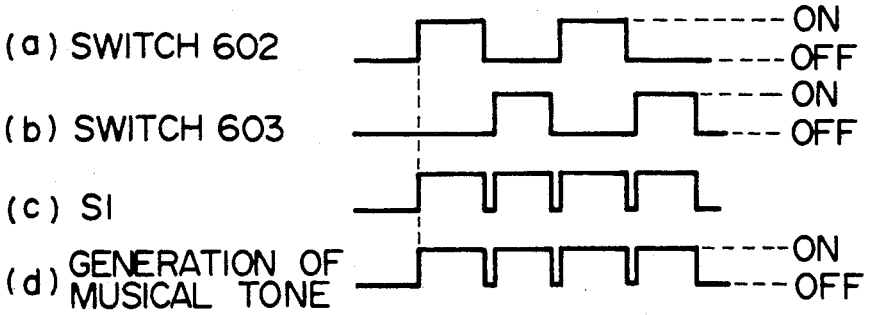
FIGS. 32(*a*) to 32(*e*) show waveforms of signals at several points of the circuit shown in FIG. 31.

Next, description will be given with respect to an eighth embodiment of the present invention in conjunction with FIGS. 30 to 32. FIG. 30 is a side view showing an appearance of a rhythm stick 601 used in the eighth embodiment. In FIG. 30, push-button type key-on switches 602 and 603 are mounted near a holding portion 601*a* of the stick 601. More specifically, the key-on switches 602 and 603 are mounted at respective positions where the thumb and the index finger of the player's left hand can reach. In addition, the angle detector 2 (shown in FIG. 2) is equipped within a tip edge portion of the stick 601. In the eighth embodiment, this angle detector 2 is connected to a musical tone control circuit 605 shown in FIG. 31. The key-on switches 602 and 603 are connected to each other in parallel, first terminals of the switches 602 and 603 are connected to a positive power source (not shown), and second terminals of the switches 602 and 603 are connected to a musical tone control circuit 605 and also grounded via a resistor R1. In FIG. 31, when one of the switches 602 and 603 is depressed, the "1" signal is supplied to the musical tone control circuit 605 as a signal S1. On the other hand, when both of the switches 602 and 603 are released, the "0" signal is supplied to the musical tone control circuit 605 as the signal S1. The musical tone control circuit 605 is constructed by the CPU and the like such that the musical tone control circuit 605 generates tone pitch data KC based on the on/off states of the mercury switches "a" to "d" of the angle detector 2 shown in FIG. 2. Next, this musical tone control circuit 605 outputs the tone pitch data KC, key-on data KND and key-off data KFD to a musical tone signal generating circuit 606.

Next, description will be given with respect to an operation of the eighth embodiment. When the player operates the switches 602 and 603, the switches 602 and 603 output signals shown in FIGS. 32(*a*) and 32(*b*), for example. Due to these output signals, the signal S1 shown in FIG. 32(*c*) is generated. When the musical tone control circuit 605 detects a leading edge timing of the signal S1, the musical tone control circuit 605 generates the tone pitch data KC in response to the swinging angle of the player's arm. Then, the musical tone control circuit 605 outputs the tone pitch data KC and the key-on data KND together to the musical tone signal generating circuit 606. Thus, the speaker SP generates or stops generating the musical tone as shown in FIG. 32(*d*). When the speaker SP stops generating the musical tone, the speaker SP can attenuate the tone volume of the musical tone and then eliminate the musical tone. When comparing the waveform shown in FIG. 32(*a*) with that shown in FIG. 32(*c*), it is apparent that the eighth embodiment can control the on/off of the musical tone with a speed much higher than the speed in case where only one switch is mounted on the stick, because the eighth embodiment uses two switches 602 and 603.

[I] NINTH EMBODIMENT

Figure 33:
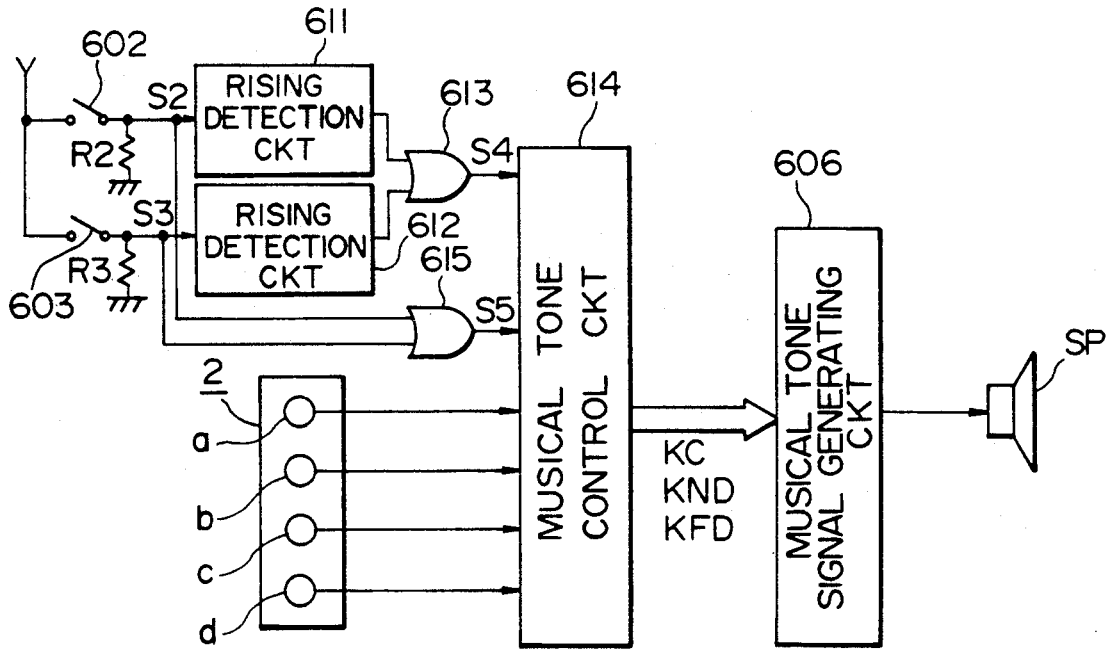
FIG. 33 is a block diagram showing the ninth embodiment.

Next, description will be given with respect to a ninth embodiment of the present invention in conjunction with FIGS. 33 and 34. FIG. 33 is a block diagram showing an electric constitution of the ninth embodiment. The first terminals of the switches 602 and 603 are both connected to a positive power source (not shown). On the other hand, the second terminals of the switches 602 and 603 are respectively connected to rising detection circuits 611 and 612. In addition, the second terminals of the switches 602 and 603 are respectively grounded via resistors R2 and R3. When the rising detection circuits 611 and 612 detect respective output signals S2 and S3 (shown in FIGS. 34(*a*) and 34(*b*)) of the switches 602 and 603, the rising detection circuits 611 and 612 output respective detection pulses to an OR gate 613 wherein a signal S4 (shown in FIG. 34(*c*)) is generated and outputted to a musical tone control circuit 614. Next, an OR gate 615 generates a signal S5 (shown in FIG. 34(*d*)) based on the signals S2 and S3, and such signal S5 is supplied to the musical tone control circuit 614. This musical tone control circuit 614 generates the tone pitch data KC based on the signals S4 and S5 and the on/off data of the angle detector 2. Then, the musical tone control circuit 614 outputs the tone pitch data KC, the key-on data KND and the key-off data KFD together to the musical tone signal generating circuit 606.

Figure 34:
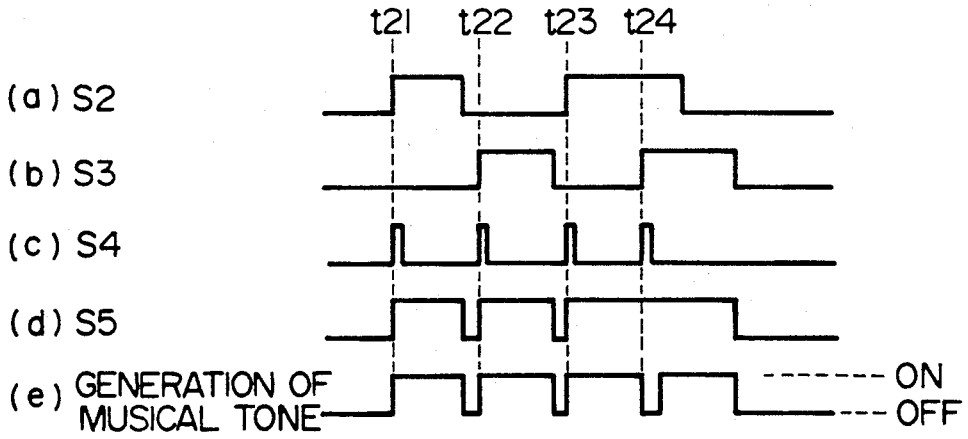
FIGS. 34(*a*) to 34(*e*) show waveforms of signals at several points of the circuit shown in FIG. 33.

When the player operates the switches 602 and 603, the switches 602 and 603 generate the signals S2 and S3 respectively shown in FIGS. 34(*a*) and 34(*b*), for example. In this case, the OR gates 613 and 615 generate the signals S4 and S5 respectively shown in FIGS. 34(*c*) and 34(*d*), and these signals S4 and S5 are supplied to the musical tone generating circuit 614. The musical tone control circuit 614 detects leading edge timings t21, t22 and t23 of the signal S5 and generates the tone pitch data KC as described before. Then, the musical tone control circuit 614 outputs the tone pitch data KC and key-on data KND together to the musical tone signal generating circuit 606 at the times t21 to t24. On the contrary, at every time when the musical tone control circuit 614 detects trailing edge timings of the signal S5, the musical tone control circuit 614 outputs the key-off data KFD to the musical tone signal generating circuit 606. At the time t24, the signal S5 rises up to the "1" signal. In other words, at the time t24, the musical tone control circuit 614 detects that the switch 603 is turned on while the switch 602 is at the "on" state. At this time t24, the musical tone control circuit 614 once outputs the key-off data KFD to the musical tone signal generating circuit 606. Next, at a certain time slightly after the time t24, the musical tone control circuit 614 outputs the tone pitch data KC and the key-on data KND to the musical tone signal generating circuit 606. Thus, the speaker SP generates or stops generating the musical tone as shown in FIG. 34(*e*).

As described heretofore, the eighth embodiment changes key-on/key-off timings by using two key-on switches 602 and 603 which are depressed alternately as shown in FIG. 34. Hence, the ninth embodiment using two switches can change the key-on/key-off timings with double speed of a speed of an embodiment using only one switch (not shown). Even when the player does not depress the key-on switches 602 and 603 with accurate timings, the ninth embodiment can perform a key-on operation at every time when the player depresses one of the switches 602 and 603. Hence, it is expected to obtain a further effect for performing a tune having a tolyl or decoration notes with ease.

Incidentally, the eighth and ninth embodiment use two key-on switches, however, the present invention is not limited to that. Hence, it is possible to re-design the eighth and ninth embodiment to have more than two switches. Meanwhile, the eighth and ninth embodiments control the tone pitch of the musical tone in response to the output of the angle detector 2. Instead of such tone color, it is possible to control the tone color and the tone volume of the musical tone in the eighth and ninth embodiments.

[J] TENTH EMBODIMENT

Figure 1:
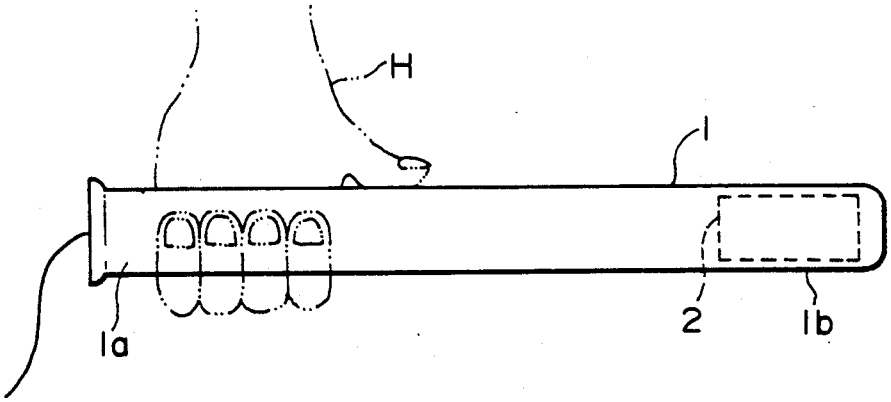
FIG. 1 shows an appearance of the stick used in the first example of the proposed musical tone control apparatus.
Figure 2:
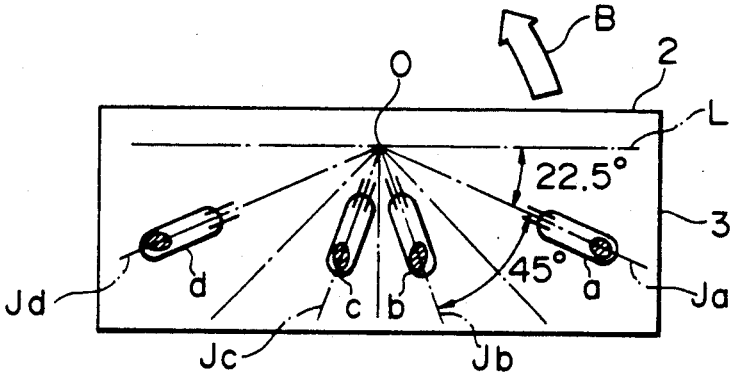
FIG. 2 shows the angle detector equipped within the stick shown in FIG. 1.
Figure 3:
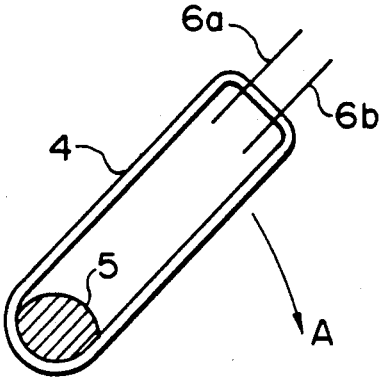
FIG. 3 is a sectional view showing a construction of each of the mercury switches which are arranged in the angle detector shown in FIG. 2.
Figure 4:
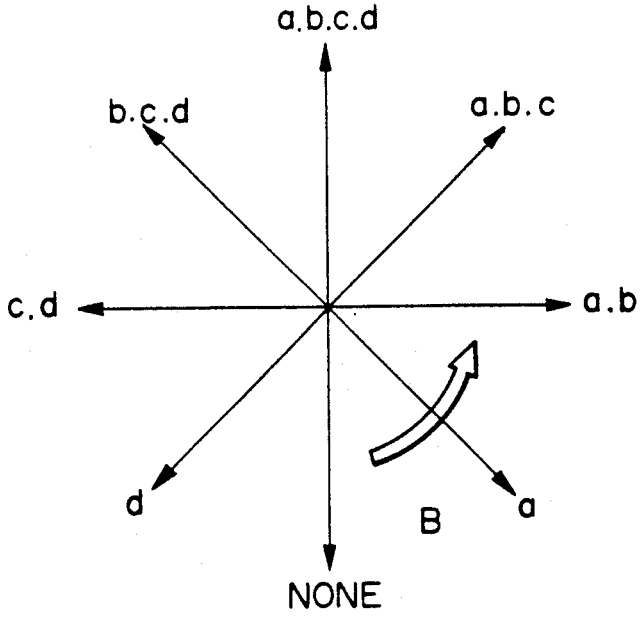
FIG. 4 is a drawing showing the on/off states of the mercury switch.
Figure 35:
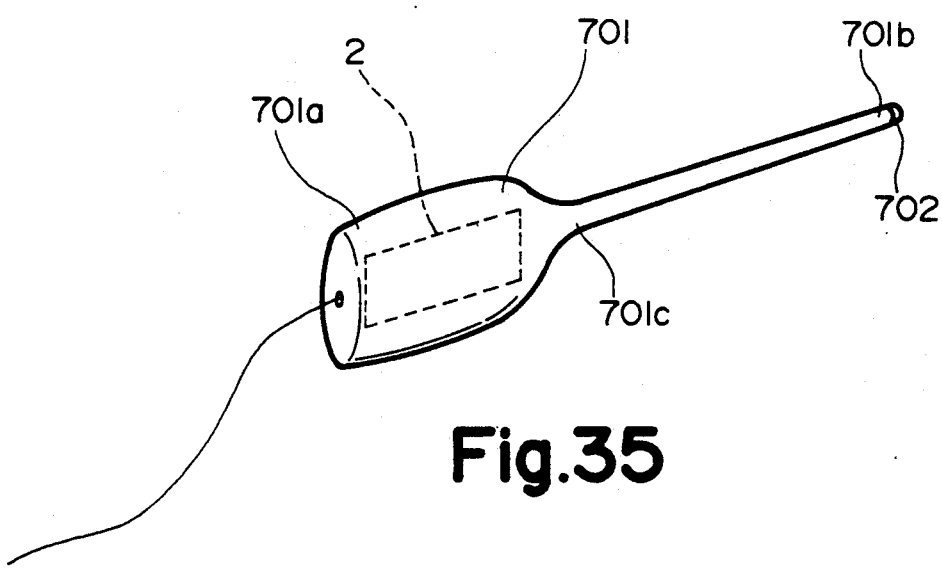
FIG. 35 shows an appearance of a rhythm stick used in a tenth embodiment.
Figure 36:
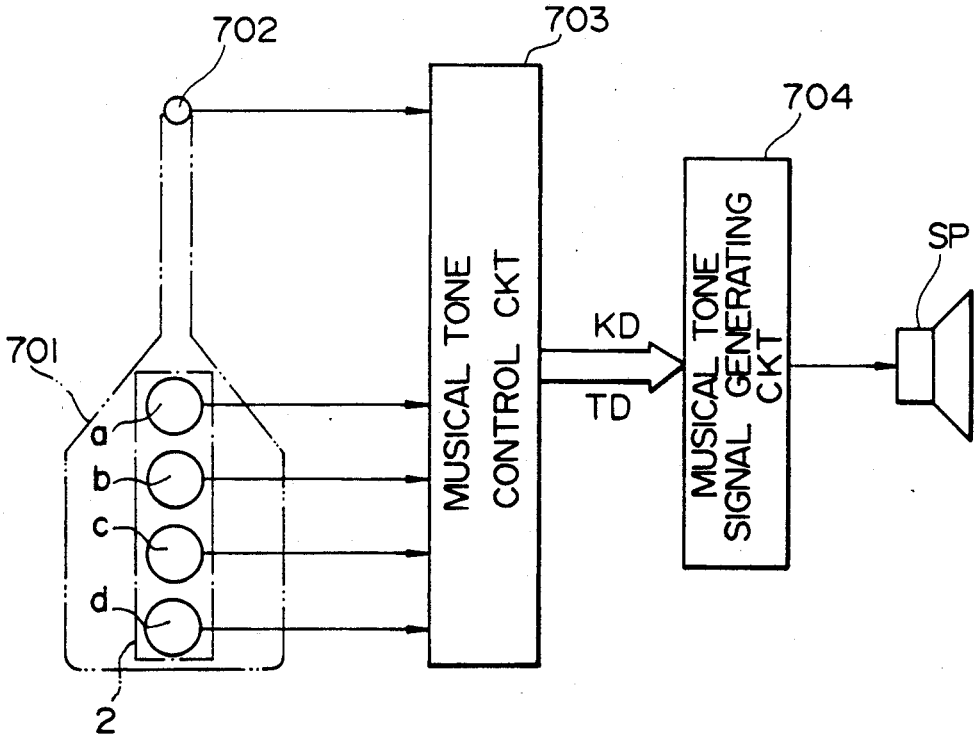
FIG. 36 is a block diagram showing the tenth embodiment.

Next, description will be given with respect to a tenth embodiment of the present invention in conjunction with FIGS. 35 and 36. FIG. 35 shows an outside appearance of a rhythm stick 701 according to the tenth embodiment of the present invention, and FIG. 36 is a block diagram showing an electrical constitution of the tenth embodiment. As shown in FIG. 35, the stick 701 provides a holding portion 701*a* having a shape which can be held by the player's hand, and a center portion 701*c* the size of which becomes smaller toward a tip edge portion 701*b*. In addition, the stick 701 is formed such that a slender stick is formed between the center portion 701*c* and the tip edge portion 701*b*. Further, the angle detector 2 shown in FIG. 2 is equipped within the holding portion 701*a*. Furthermore, a piezoelectric element 702 is equipped at the tip edge portion 701*b* of the stick 701.

As shown in FIG. 36, a musical tone control circuit 703 is connected with the mercury switches "a" to "d" constituting the angle detector 2 and the piezoelectric element 702. This musical tone control circuit 703 detects an angle formed between the angle detector 2 and the ground based on the on/off states of the mercury switches "a" to "d". In other words, the musical tone control circuit 703 detects the swinging angle of the player's hand holding the stick 701. Hence, the musical tone control circuit 703 generates the tone pitch data KD corresponding to the detecting result thereof, and such tone pitch data KD are supplied to a musical tone signal generating circuit 704. In addition, the musical tone control circuit 703 generates tone color designating data TD for designating the tone color of the piano, organ or the flute based on a detection signal outputted from the piezoelectric element 702, for example. Such tone color designating data TD are supplied to the musical tone signal generating circuit 704.

In this case, at every time when the piezoelectric element 702 is pressed against a wall and the like by one time, the musical tone control circuit 703 sequentially designates the tone color of the piano, the organ and the flute, for example. The musical tone signal generating circuit 704 generates a musical tone signal having a tone pitch corresponding to the tone pitch data KD and also having a tone color corresponding to the tone color designating data TD. Such musical tone signal is supplied to the speaker SP, whereby the speaker SP generates a musical tone having a tone pitch corresponding to the swinging angle of the player's hand holding the stick 701. Further, the tone color of the musical tone is changed at every time when the piezoelectric element equipped at the tip edge portion 701*b* of the stick 701 is pressed against the wall.

According to the tenth embodiment, the stick 701 has a slender stick shape having a desirable length between the center portion 701*c* and the tip edge portion 701*b*. Hence, it is possible to visually recognize the swinging angle of the player's hand holding the holding portion 701*a* of the stick 701. In addition, since the tenth embodiment equips the angle detector 2 within the holding portion 701*a* of the stick 701, it is possible to minimize effects of the impulse force and the centrifugal force which are applied to the angle detector 2 when the player swings up and down the stick 701. As a result, it is possible to remarkably reduce the number of detection errors which are caused in the angle detector 2.

In the above-mentioned tenth embodiment, the tone pitch of the musical tone is changed in response to the swinging angle of the stick 701, and the tone color of the musical tone is sequentially changed at every time when the player presses the tip edge portion 701*b* of the stick 701 against the wall. However, the present invention is not limited to that. For example, it is possible to re-design the tenth embodiment such that the player can change the tone volume or the performance speed of the musical tone, or a rhythm pattern of percussive tones. In addition, it is also possible to re-design the tenth embodiment such that the acceleration sensor is equipped within the holding portion 701*a* of the stick 701, instead of the angle detector 2. In this case, the tone pitch, the tone color and the tone volume of the musical tone can be changed in correspondence with the acceleration applied to the stick 701.

[K] ELEVENTH EMBODIMENT

Figure 37B:
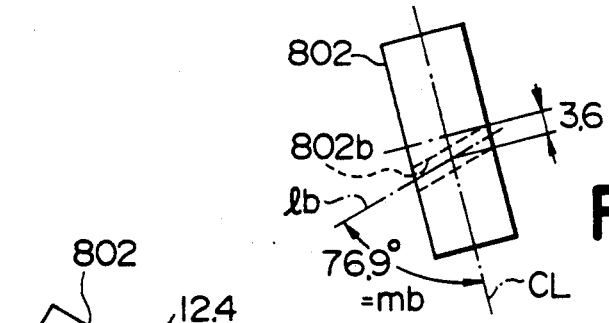
FIGS. 37A to 37E are fragmentary views each showing an angle detector for a player's left hand used in an eleventh embodiment.
Figure 37A:
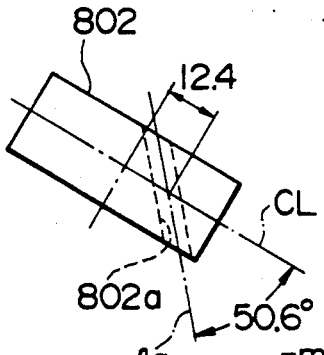
Figure 37E:
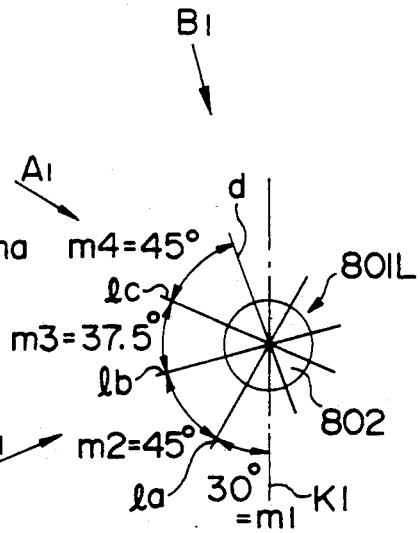
Figure 37D:
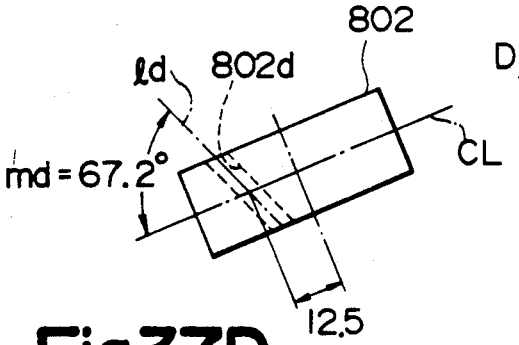
Figure 37C:
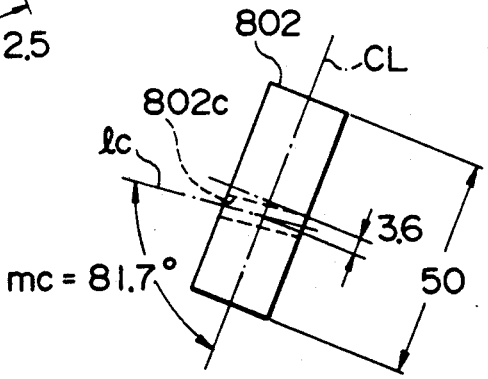
Figures 38A, 38B, 38C, 38D, 38E:
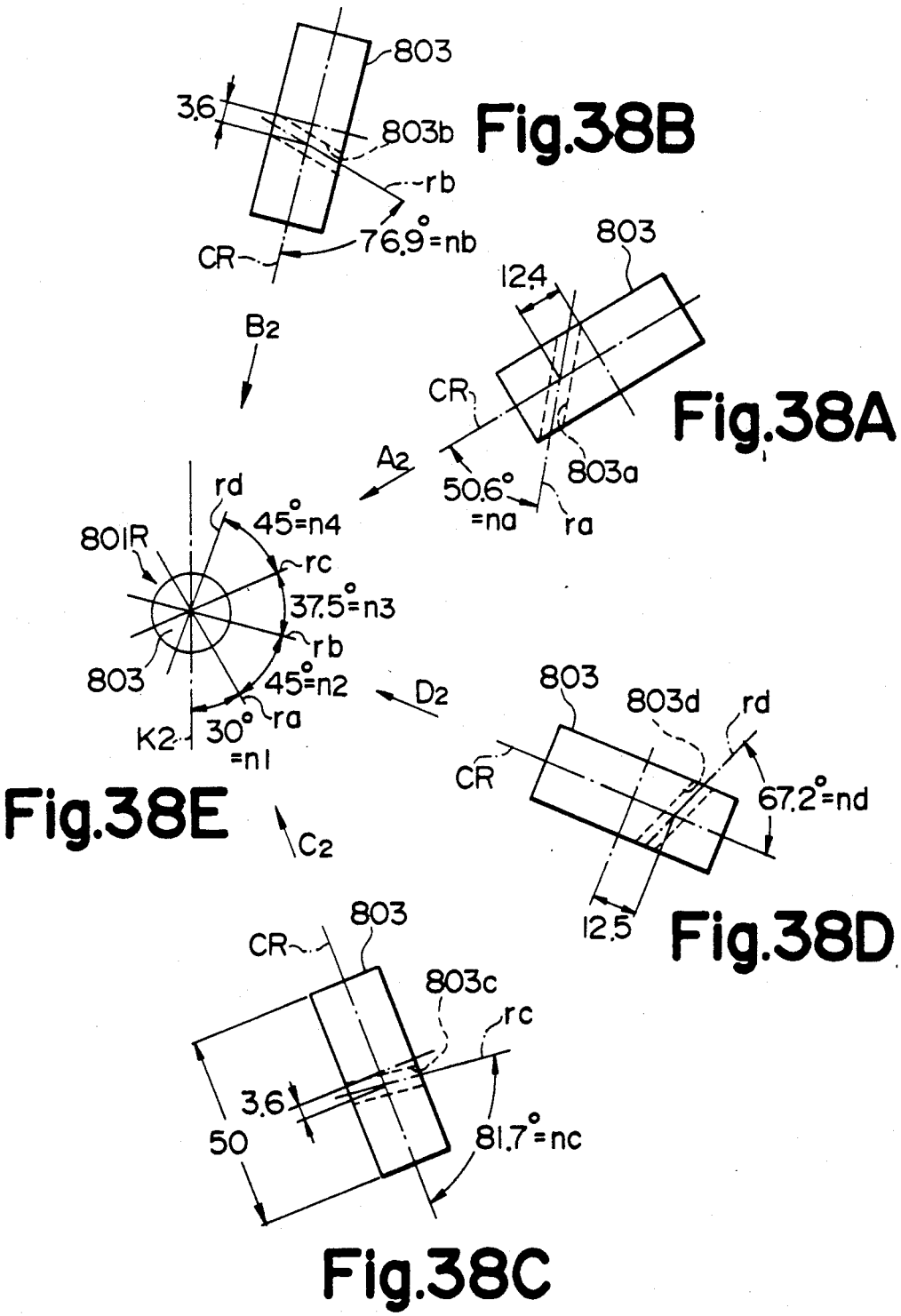
FIGS. 38A to 38E are fragmentary views each showing an angle detector for a player's right hand used in the eleventh embodiment.
Figure 39:
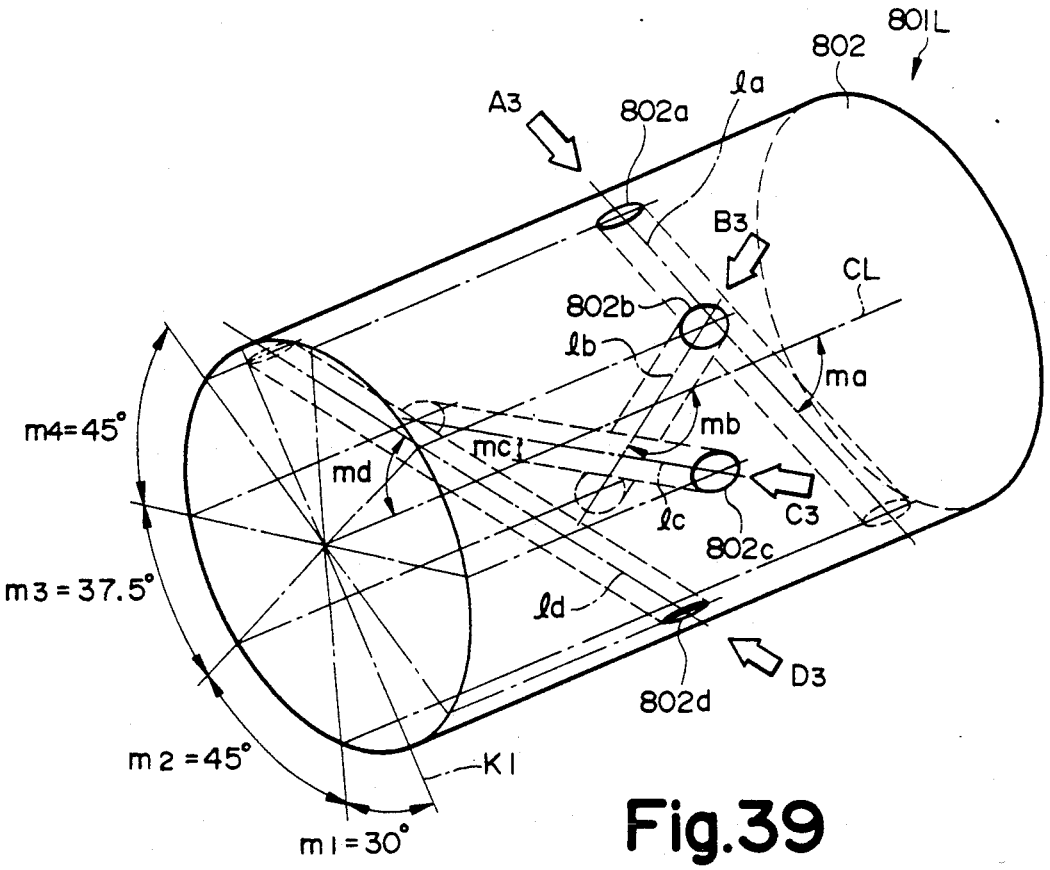
FIG. 39 is a perspective side view showing the angle detector for the player's left hand.
Figure 40:
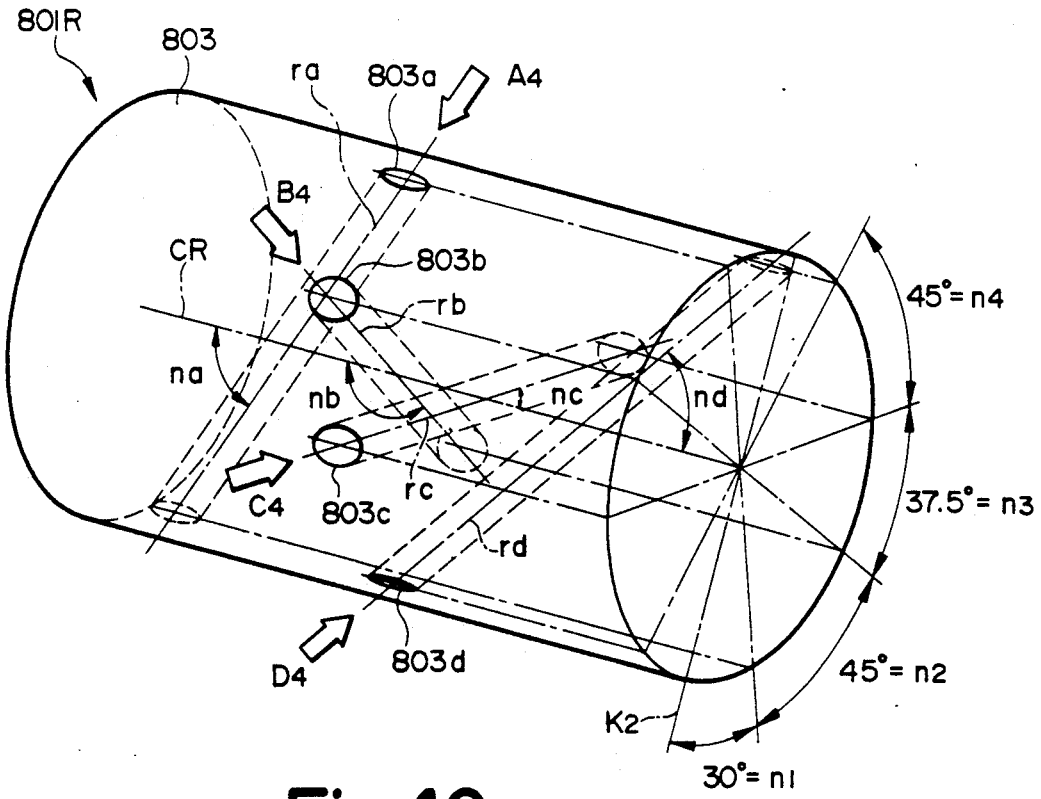
FIG. 40 is a perspective side view showing the angle detector for the player's right hand.

Next, description will be given with respect to an eleventh embodiment in conjunction with FIGS. 37A to 40. FIG. 37E is a plan view showing an angle detector 801L for the player's left hand, and FIGS. 37A to 37D are fragmentary views taken in respective directions $A_1$ to $D_1$. Similarly, FIG. 38E is a plan view showing an angle detector 801R for the player's right hand, and FIGS. 38A to 38D are fragmentary views taken in respective directions $A_2$ to $D_2$. FIG. 39 is a perspective side view showing the angle detector 801L, and FIG. 40 is a perspective side view showing the angle detector 801R.

As shown in FIGS. 37A to 37E and FIG. 39, the angle detector 801L consists of a cylindrical member 802 having four through holes 802*a*, 802*b*, 802*c* and 802*d*. In addition, the mercury switches "a" to "d" (shown in FIG. 2) are inserted into the four through holes 802*a* to 802*d* respectively. Similarly, as shown in FIGS. 38A to 38E and FIG. 40, the angle detector 801R consists of a cylindrical member 803 having four through holes 803*a*, 803*b*, 803*c* and 803*d*. In addition, the other mercury switches "a" to "d" are inserted into the four through holes 803*a* to 803*d* respectively.

Next, description will be given with respect to respectively formed directions of the through holes 802*a* to 802*d* and the through holes 803*a* to 803*d*. More specifically, detailed description will be given with respect to relative relations among the center axes Ja to Jd of the mercury switches "a" to "d".

When a viewpoint is taken in an edge plane direction of the cylindrical member 802 constituting the angle detector 801L, angles of center lines 1*a* to 1*d* of the through holes 802*a* to 802*d* formed against a reference line K1 (drawn in a radius direction) sequentially vary as 30 degrees (=m1), 75 degrees (=m1+m2), 112.5 degrees (=m1+m2+m3) and 157.5 degrees (=m1+m2+m3+m4) in a clockwise direction. On the other hand, when a viewpoint for the cylindrical member 802 shown in FIG. 37E is taken in the direction $A_1$, an angle of 50.6 degrees (=ma) is formed for the center line 1*a* of the through hole 802*a* against an axis line CL of the cylindrical member 802 as shown in FIG. 37A. Similarly, when a viewpoint for the cylindrical member 802 is taken in the directions $B_1$, $C_1$ and $D_1$ respectively, angles of 76.9 degrees (=mb), 81.7 degrees (=mc) and 67.2 degrees (=md) are respectively formed for the center lines 1*b*, 1*c* and 1*d* of the through holes 802*b*, 802*c* and 802*d* against the axis line CL of the cylindrical member 802 as shown in FIGS. 37B to 37D.

Thus, as shown in FIG. 39, the through holes 802*a* to 802*d* are spirally formed along the axis line CL, and the mercury switches "a" to "d" are inserted into the through holes 802*a* to 802*d* in respective directions $A_3$, $B_3$, $C_3$ and $D_3$. As a result, the center axes Ja to Jd of the mercury switches "a" to "d" are spirally arranged. Meanwhile, in the case where the angle detector 801L is revolved around the shoulder joint of the player's left arm in his left side direction, a revolution due to a twisting of his left wrist must be caused. In order to cancel an effect of such twisting of the player's left wrist, the above-mentioned angles m1 to m4 are determined based on a human engineering.

On the other hand, the angle detector 801R consists of a cylindrical member 803 having four through holes 803*a* to 803*d* which are formed symmetrically with respect to the holes 802*a* to 802*d* of the cylindrical member 802. As shown in FIG. 38E, angles formed between the center lines ra to rd of the through holes 803*a* to 803*d* and a reference line K2 (drawn in a radius direction) sequentially vary as 30 degrees (=n1), 75 degrees (=n1+n2), 112.5 degrees (=n1+n2+n3) and 157.5 degrees (=n1+n2+n3+n4) respectively in a counterclockwise direction. Other angles na to nd and the like of the cylindrical member 803 are determined similar to those of the cylindrical member 822. In FIGS. 37A to 37D and FIGS. 38A to 38D, lengths at several portions of the cylindrical members 802 and 803 are described in a unit of millimeter in order to define the positions of the through holes 802*a* to 802*d* and 803*a* to 803*d*.

Next, the musical tone control circuit 7 shown in FIG. 5 is connected with the mercury switches of the angle detectors 801L and 801R. Thus, the musical tone control circuit 7 can detect the swinging angles of the player's left hand holding the angle detector 801L and the player's right hand holding the angle detector 801R as well based on the on/off states of the mercury switches "a" to "d". Then, the musical tone signal generating circuit 8 is supplied with the tone pitch data KD corresponding to the detecting results of the musical tone control circuit 7. As a result, the speaker 9 generates a musical tone having a tone pitch corresponding to the swinging angles of the player's both hands.

According to the eleventh embodiment described heretofore, the mercury switches "a" to "d" are spirally arranged so as to cancel the revolution due to the twisting of the player's wrist which is occurred in the case where the player's arm is revolved around his shoulder joint in his side direction. Hence, the eleventh embodiment can detect the swinging angle of the player's arm with accuracy and generate the musical tone having the tone pitch corresponding to the detected swinging angle. In addition, it is possible to design the angle detectors 801L and 801R to have desirably minimized outside scales.

Incidentally, the eleventh embodiment is designed to change the tone pitch of the musical tone in response to the swinging angles of the player's hands. However, the present invention is not limited to that. Hence, it is possible to re-design the eleventh embodiment such that the tone volume, the performance speed or the rhythm patterns of the percussive tones can be changed in response to the swinging angles of the player's hands.

[L] TWELFTH EMBODIMENT

Figure 41:
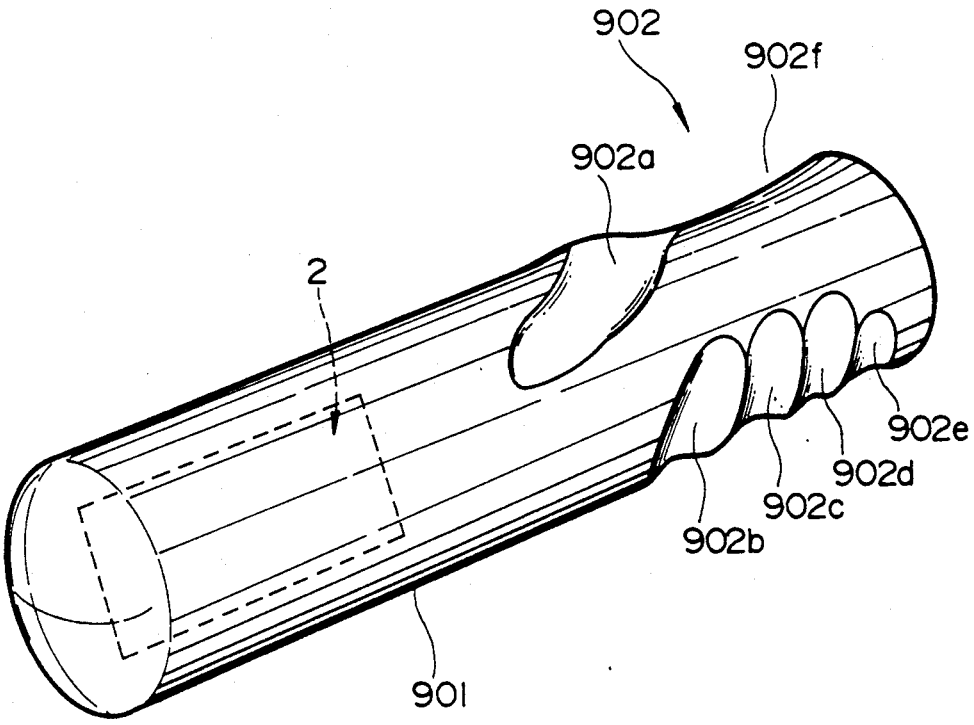
FIG. 41 is a perspective side view showing a stick used in a twelfth embodiment.

Next, description will be given with respect to a twelfth embodiment of the present invention in conjunction with FIG. 41. FIG. 41 is a perspective side view showing an appearance of a stick 901 used in the twelfth embodiment. In FIG. 41, 901 designates a stick 901, and a holding portion 902 is formed near an edge portion of the stick 901. This holding portion 902 has concave portions 902*a* to 902*e* to be adapted with five fingers of the player's right hand. More specifically, the concave portion 902*a* has a shape to be adapted with the thumb, the concave portion 902*b* has a shape to be adapted with the index finger, the concave portion 902*c* has a shape to be adapted with a middle finger, the concave portion 902*d* has a shape to be adapted with a third finger, and the concave portion 902*e* has a shape to be adapted with a little finger. In addition, a concave portion 902*f* has a shape (not shown in detail) to be adapted with a palm of the player's right hand.

On the other hand, the angle detector 2 shown in FIG. 2 is equipped within the other edge portion of the stick 901. In the twelfth embodiment, this angle detector 2 is arranged such that the plane of the support plate 3 of the angle detector 2 coincides with the plane including the plumb line, in the case where the player's right hand holds the holding portion 902 such that his thumb is turned to the upper side, and the five fingers and the palm of his right hand are adapted with the concave portions 902*a* to 902*f* respectively. In addition, respective terminals of the mercury switches "a" to "d" of the angle detector 2 are connected to the musical tone control circuit 7 shown in FIG. 5.

According to the twelfth embodiment, the plane of the support plate 3 of the angle detector 2 can coincide with the plane including the plumb line by only holding the holding portion 902 of the stick 901 with the player's right hand. Therefore, even a child can notice the method how to hold the stick 901 with ease.

[M] THIRTEENTH EMBODIMENT

Figure 42:
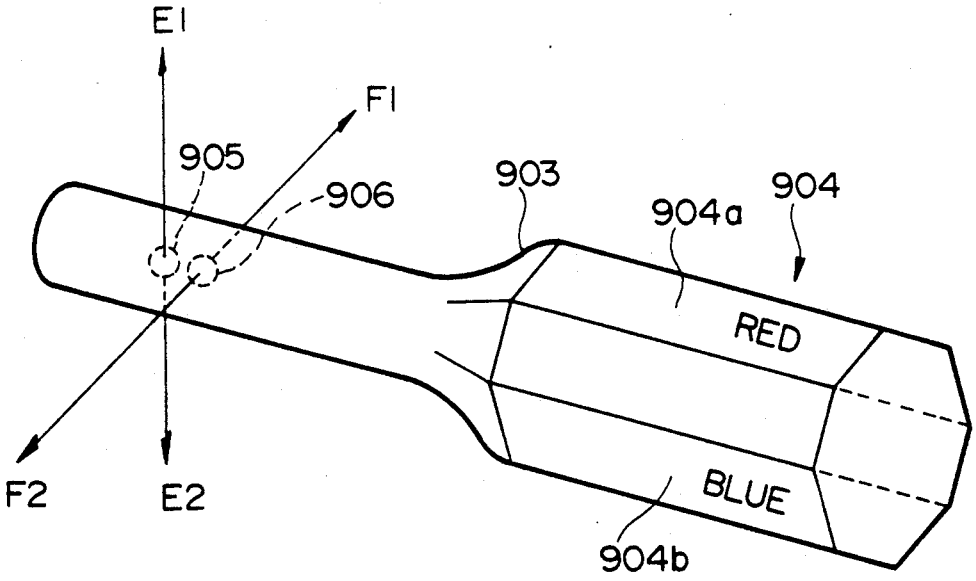
FIG. 42 is a perspective side view showing a stick used in a thirteenth embodiment.
Figure 43:
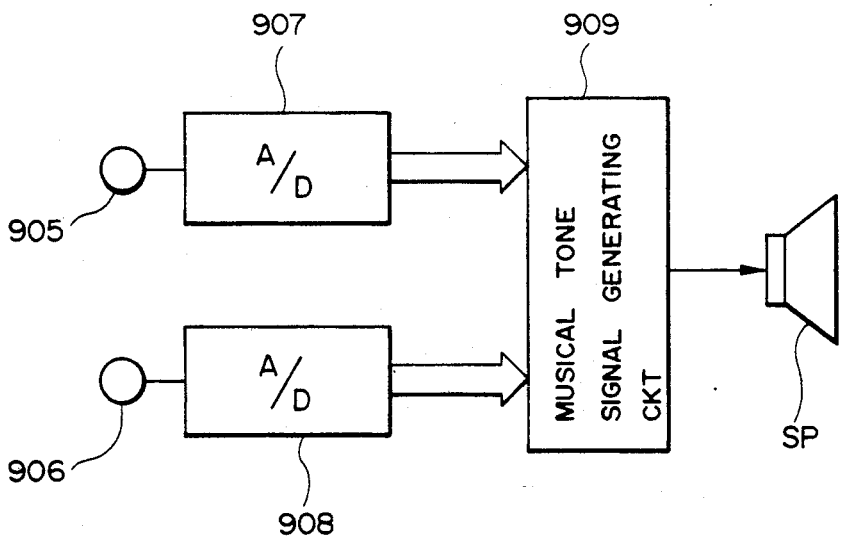
FIG. 43 is a block diagram showing the thirteenth embodiment.

Next, description will be given with respect to a thirteenth embodiment in conjunction with FIGS. 42 and 43. FIG. 42 is a perspective side view showing an appearance of a stick 903 used in the thirteenth embodiment. As shown in FIG. 42, this stick 903 provides a holding portion 904 having an edge portion shaped like an octagon. Hence, the holding portion 904 has eight side planes including planes 904*a* and 904*b*. This plane 904*a* of such holding portion 904 is colored red, and the plane 904*b* perpendicular to the plane 904*a* is colored blue. In addition, acceleration sensors 905 and 906 are equipped within a tip edge portion of the stick 903. Each of these acceleration sensors 905 and 906 uses the piezo plastic film having a thin disc shape as a vibrator thereof. This acceleration sensor 905 detects an acceleration applied thereto in directions E1 and E2, and the acceleration sensor 906 detects an acceleration applied thereto in directions F1 and F2. The detection signals outputted from the acceleration sensors 905 and 906 are respectively supplied to analog-to-digital (A/D) converters 907 and 908, wherein these detection signals are sampled by a predetermined cycle and converted into respective digital data. Hence, the A/D converters 907 and 908 output respective digital data to a musical tone signal generating circuit 909. Thus, the musical tone signal generating circuit 909 generates a first signal representative of a cymbal tone having a tone volume corresponding to the output of the A/D converter 907 and also generates a second signal representative of a bass drum tone having a tone volume corresponding to the output of the A/D converter 908. These first and second signals are subjected to a mixing and then supplied to the speaker SP.

In the case where the player holds the holding portion 904 such that his thumb is adapted with the plane 904*a* and the player swings up and down the stick 903, the speaker SP generates the cymbal tone having the tone volume corresponding to the acceleration applied to the tip edge portion of the stick 903. In addition, in the case where the player holds the holding portion 904 as described above and swings the stick 903 horizontally, the speaker SP generates the bass drum tone having the tone volume corresponding to the acceleration applied to the tip edge portion of the stick 903. On the other hand, in the case where the player holds the holding portion 904 such that his thumb is adapted with the plane 904*b* and the player swings up and down the stick 903, the speaker SP generates the bass drum tone having the tone volume corresponding to the acceleration applied to the tip edge portion of the stick 903.

Above is the description of the thirteenth embodiment. According to the thirteenth embodiment, it is possible to change the tone depending on how to hold the holding portion 904 of the stick 903 when the player swings the stick 903 in a predetermined direction. In addition, since the planes 904*a* and 904*b* of the holding portion 904 is colored red and blue, even a child can notice the method how to hold the holding portion 904 with ease. Further, since each of the eight side planes of the holding portion 904 is flat, it is possible to draw characters and pictures (representative of kinds of musical instruments) on each side plane of the holding portion 904.

Incidentally, the twelfth and thirteenth embodiments control the tone pitch and the tone volume of the musical tone in response to the swinging angle of the player's arm. However, the present invention is not limited to that. Hence, it is possible to re-design the twelfth and thirteenth embodiments to control the tone color and the tone length of the musical tone in response to the swinging angle of the player's arm.

[N] FOURTEENTH EMBODIMENT

Figure 9:
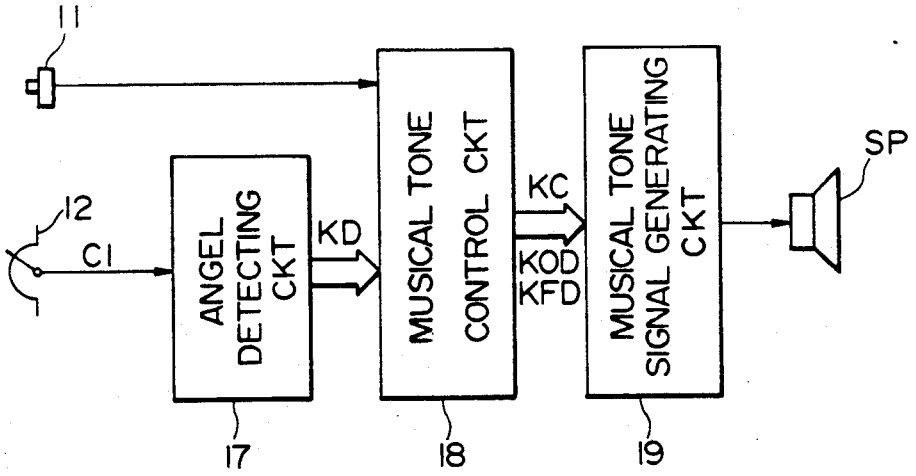
FIG. 9 is a block diagram showing the second example of the proposed musical tone control apparatus.
Figure 44:
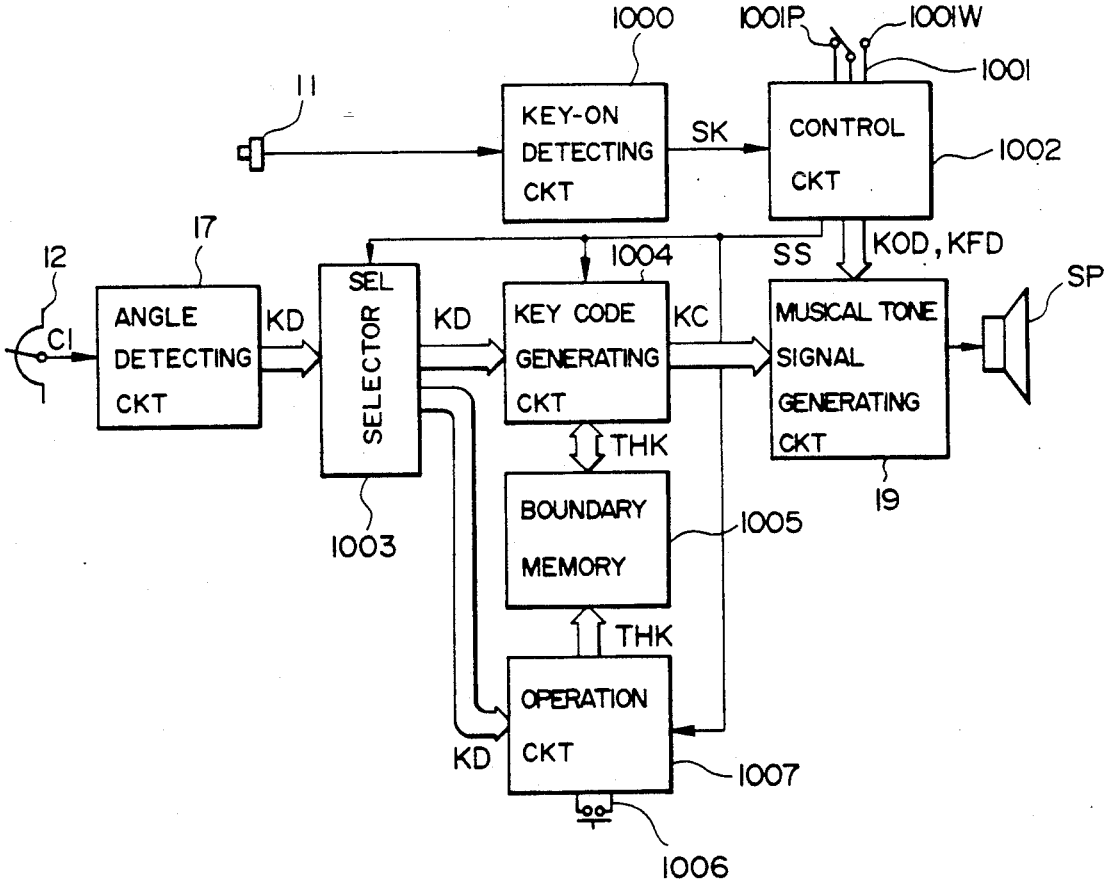
FIG. 44 is a block diagram showing a fourteenth embodiment.

Next, description will be given with respect to a fourteenth embodiment of the present invention in conjunction with FIG. 44. In FIG. 44, parts similar to those shown in FIG. 9 will be designated by the same numerals, and description thereof will be omitted. FIG. 44 is a block diagram showing the fourteenth embodiment of the present invention. In FIG. 44, the key-on switch 11 shown in FIG. 9 is connected to a key-on detecting circuit 1000, and the detection signal C1 outputted from the angle detector 12 is supplied to the angle detecting circuit 17. When the key-on detecting circuit 1000 detects that the switch 11 is turned on, the level of the output signal SK thereof will be set to the "1" level. On the other hand, when the key-on detecting circuit 1000 detects that the switch 11 is turned off, the level of the output signal SK thereof will be set to the "0" level. In addition, a mode switch 1001 is mounted on a panel plane (not shown). This mode switch 1001 provides contacts 1001*p* and 1001*w* for respectively selecting a play mode and a tone pitch setting mode. Further, a control circuit 1002 constructed by the CPU and the like is designed to monitor an operating state of the mode switch 1001. When the tone pitch setting mode is selected by the mode switch 1001, the control circuit 1002 sets the level of the output signal SS thereof to the "1" level. On the other hand, when the play mode is selected by the mode switch 1001, the control circuit 1002 sets the level of the output signal SS thereof to the "0" level. In addition, the control circuit 1002 monitors the signal SK outputted from the key-on detecting circuit 1000. When the control circuit 1002 detects a leading edge timing of the signal SK, the control circuit 1002 outputs key-on data KOD. On the other hand, when the control circuit 1002 detects a trailing edge timing of the signal SK, the control circuit 1002 outputs key-off data KFD. The key-on data KOD and the key-off data KFD are independently supplied to the musical tone signal generating circuit 19 shown in FIG. 9.

When the signal SS having the "0" level is supplied to a terminal SEL of a selector 1003, the selector 1003 directly outputs the angle data KD outputted from the angle detecting circuit 17 from the output terminal A thereof, and such angle data KD are supplied to a key code generating circuit 1004. On the other hand, when the signal SS having the "1" level is supplied to the selector 1003, the selector 1003 directly outputs the angle data KD from the output terminal B thereof, and such angle data KD are supplied to an operation circuit 1007. When the signal SS having the "0" level is supplied to the key code generating circuit 1004, the key code generating circuit 1004 generates tone pitch data KC corresponding to the angle data KD, and such tone pitch data KC are supplied to the musical tone signal generating circuit 19.

Meanwhile, a boundary memory 1005 constructed by a random access memory (RAM) and the like is designed to store an angle boundary value which will be described later. Next, when the signal SS having the "1" level is supplied to the operation circuit 1007, the operation circuit 1007 starts to monitor an operating state of a write switch 1006. At every time when the write switch 1006 is depressed, the operation circuit 1007 stores the angle data KD outputted from the selector 1003. After the operation circuit 1007 stores the angle data KD by predetermined times, the operation circuit 1007 calculates an average angle value of two angles P represented by two angle data KD which are continuously stored therein. More specifically, the operation circuit 1007 effects an operation formula $[P_{(j+1)}+P_j]/2$ on the stored angle data KD so as to obtain an angle boundary value $THK_j$. Such angle boundary value $THK_j$ is written in the boundary memory 1005.

Next, description will be given with respect to an operation of the fourteenth embodiment. When the power is given to the musical tone control apparatus shown in FIG. 44, the player operates the mode switch 1001 so as to select the tone pitch setting mode at first. When the control circuit 1002 detects that the tone pitch setting mode is selected, the control circuit 1002 outputs the signal SS having the "1" level. Next, the player swings up his arm by an angle corresponding to desirable tone pitch. In this case, the player sequentially changes the above angle so as to sequentially select the tone pitches do, re, mi, . . . At every time when the player selects one tone pitch, the player operates the write switch 1006 so as to perform the tone pitch setting operation. Thus, the operation circuit 1007 sequentially inputs the angle data KD via the selector 1003. Next, the operation circuit 1007 calculates out the angle boundary values THK based on the process described before. This angle boundary values THK are sequentially written in the boundary memory 1005.

Next, the player operates the mode switch 1001 so as to select the play mode. When the control circuit 1002 detects that the play mode is selected, the control circuit 1002 outputs the signal SS having the "0" level. At this time, the player swings up his arm by the predetermined angle and then depresses the key-on switch 11. Hence, the key code generating circuit 1004 sequentially compares the angle P represented by the angle data KD from the selector 1003 with the angle boundary value $THK_j$ (where $j=0, 1, 2, \ldots$). Thus, the key code generating circuit 1004 generates the tone pitch data KC corresponding to the number j when the angle P is smaller than the angle boundary value $THK_j$. Such tone pitch data KC are supplied to the musical tone signal generating circuit 19. Because, each of the tone pitches do, re, mi, . . . is assigned to each of angle ranges which are divided by the angle boundary values THK. Therefore, the key code generating circuit 1004 generates the tone pitch data KC representative of the tone pitch which is assigned to the angle range including the swinging angle P of the player's arm.

Meanwhile, when the control circuit 1002 detects the leading edge timing of the signal SK, the control circuit 1002 outputs the key-on data KOD to the musical tone signal generating circuit 19. Then, the musical tone signal generating circuit 19 generates a musical tone signal having a tone pitch corresponding to the tone pitch data KC from the key code generating circuit 1004. Such musical tone signal drives the speaker SP. Thus, the speaker SP generates the musical tone having the desirable tone pitch as described before. Finally, when the player releases the switch 11, the speaker SP stops generating the musical tone.

[O] FIFTEENTH EMBODIMENT

Figure 45:
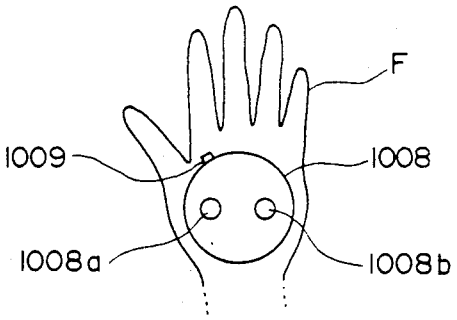
FIG. 45 is a plan view showing an appearance of a fifteenth embodiment.

Next, description will be given with respect to a fifteenth embodiment in conjunction with FIGS. 45 to 49C. In the fifteenth embodiment, parts similar to those shown in FIG. 44 will be designated by the same numerals, and description thereof will be omitted. FIG. 45 is a plan view showing a distance measuring device 1008, and this device 1008 is mounted at a palm portion of a mounting glove F. This distance measuring device 1008 has an upper portion shaped like a disc. In addition, a push-button type key-on switch 1009 is mounted at a certain position of a side portion of this device 1008. Further, an ultrasonic transmitter 1008*a* and an ultrasonic receiver 1008*b* are respectively mounted within the upper portion of this device 1008. These ultrasonic transmitter 1008*a* and ultrasonic receiver 1008*b* are both constructed by a piezoelectric element such as a barium titanate. The ultrasonic transmitter 1008*a* transmits an ultrasonic wave when a high-frequency signal is supplied thereto. The ultrasonic receiver 1008*b* outputs the high-frequency signal when the ultrasonic receiver 1008*b* receives the ultrasonic wave.

Figure 46:
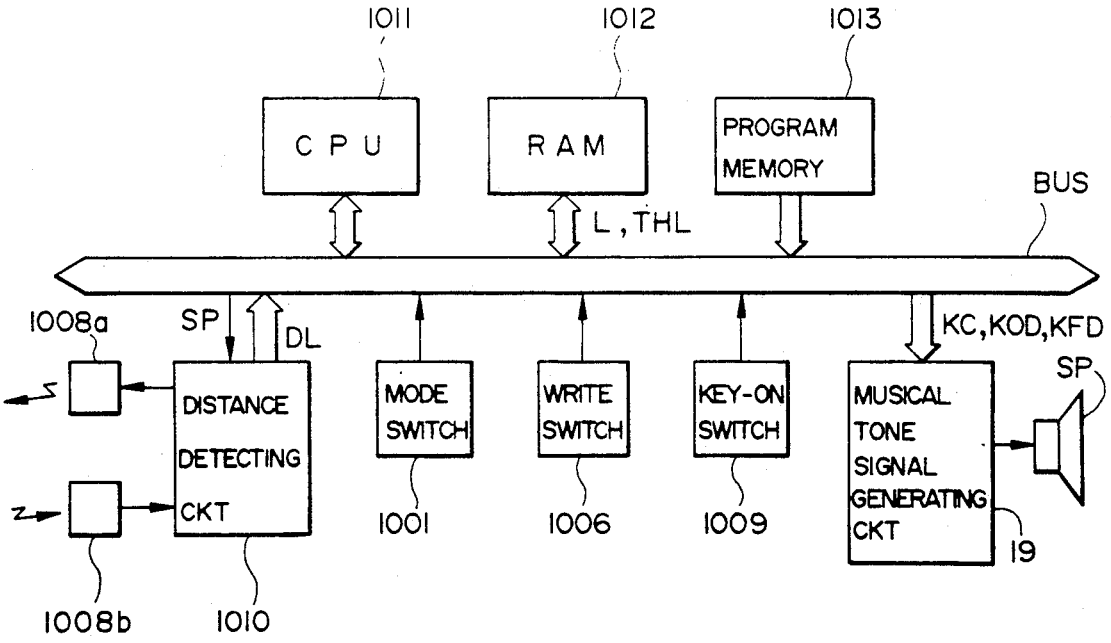
FIG. 46 is a block diagram showing the fifteenth embodiment.

The above-mentioned ultrasonic transmitter 1008*a*, the ultrasonic receiver 1008*b* and the switch 1009 of the distance measuring device 1008 are all connected to a distance detecting circuit 1010 shown in FIG. 46. When a start pulse ST is applied to the distance detecting circuit 1010 via a bus line BUS, the distance detecting circuit 1010 drives the ultrasonic transmitter 1008*a* so as to transmit the ultrasonic wave. For example, this ultrasonic wave is reflected by the wall, and such reflected ultrasonic wave is received by the ultrasonic receiver 1008*b*. The distance detecting circuit 1010 measures a distance between the palm of the player's hand and the wall based on a time difference between a first time when the ultrasonic transmitter 1008*a* transmits the ultrasonic wave and a second time when the ultrasonic receiver 1008*b* receives the reflected ultrasonic wave. Then, the distance detecting circuit 1010 outputs distance data DL representative of the above measured distance to the bus line BUS.

Next, a CPU 1011 controls the generation of the musical tone, however, detailed description thereof will be given later. In addition, a RAM 1012 provides a distance storing area TBL and a distance boundary storing area TBLH shown in FIG. 48. Further, a ROM 1013 stores predetermined programs for designating operations of the CPU 1011.

Next, description will be given with respect to an operation of the fifteenth embodiment in conjunction with FIGS. 47A to 49C. In the fifteenth embodiment, the tone pitch of the musical tone will be controlled based on the measured distance between the palm of the player's hand and the wall. At first, the player operates the mode switch 1001 so as to select the tone pitch setting mode. Thereafter, the player operates the write switch 1006 so that the tone pitch setting operation is performed.

Figure 47A:
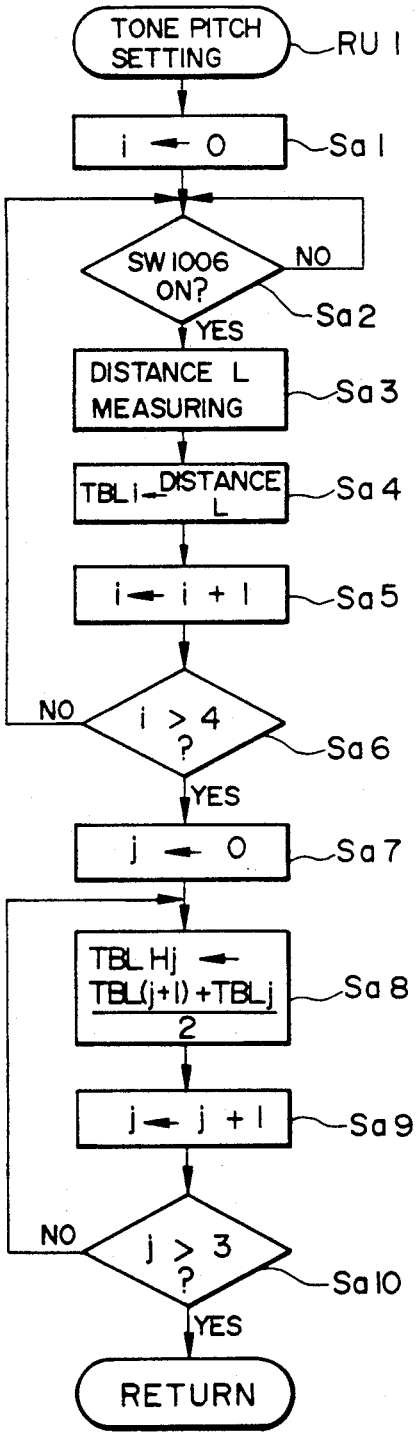
FIGS. 47A and 47B show flow charts for explaining operations of the fifteenth embodiment.
Figure 47B:
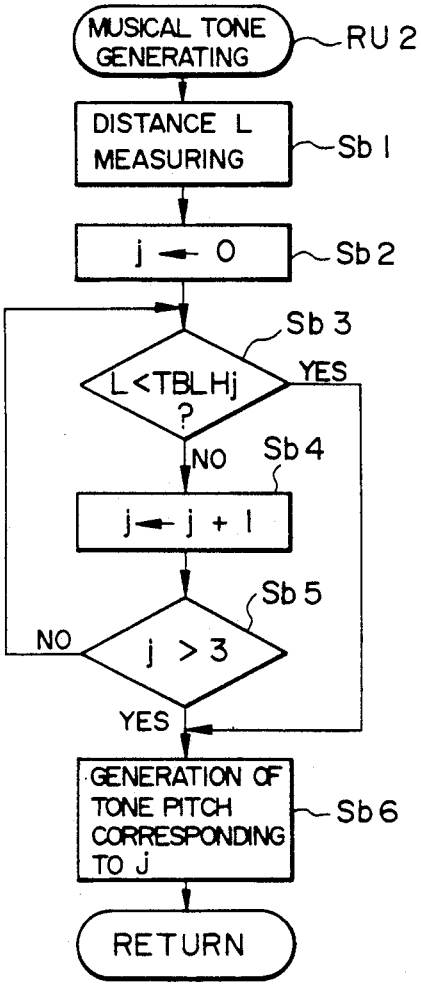

First, detailed description will be given with respect to the tone pitch setting operation by referring to a flow chart representing a tone pitch setting routine RU1 shown in FIG. 47A. In a first step Sa1, the value "0" is set to measuring times i by which the distance detecting circuit 1010 measures the distance between the player's hand and the wall, and the present process proceeds to a next step Sa2. This step Sa2 judges whether the write switch 1006 is depressed or not. When a judgment result of the step Sa2 is "NO", the present process returns back to the step Sa2 again. However, when the judgment result of the step Sa2 is "YES", the present process advances to a next step Sa3. In this step Sa3, the CPU 1011 outputs the start pulse ST to the distance detecting circuit 1010 and also inputs the distance data DL corresponding to the desirable tone pitch, and then the present process advances to a next step Sa4. In the step Sa4, the distance data DL representative of a distance L (i.e., the measured distance) are written into a position having the address corresponding to the measuring times i within the distance storing area TBL (shown in FIG. 48), and then the present process advances to a next step Sa5. In the step Sa5, the value of the measuring times i is increased by one, and then the present process advances to a next step Sa6. This step Sa6 judges whether the value of the measuring times i becomes larger than the value "4" or not. In other words, the step Sa6 judges whether an operation for measuring distances respectively corresponding to the tone pitches do, re, mi, fa and on. When a judgement result of the step Sa6 is "NO", the present process returns back to the step Sa2 again. However, when the judgment result of the step Sa6 is "YES", the present process advances to a next step Sa7. Incidentally, in the case where the judgment result of the step Sa6 is "YES", data representative of distances L0 to L4 shown in FIG. 49A have been written within the distance storing area TBL.

In the step Sa7, the value "0" is set to calculating times j of the distance boundary value THL, and then the present process advances to a next step Sa8. This step Sa8 calculates an average value between two data values stored in respective positions having addresses corresponding to the calculating times j and j+1 within the distance storing area TBL. Such calculated average value is written in a position having the address corresponding to the calculating times j within the distance boundary storing area TBLH (show in FIG. 48) as the distance boundary value THL. In a next step Sa9, the value of the calculating times j is increased by one, and then the present process advances to a next step Sa10. This step Sa10 judges whether the value of the calculating times j becomes larger than the value "3" or not. In other words, this step Sa10 judges whether a calculation of the distance boundary value THL is completed or not. If a judgment result of the step Sa10 is "NO", the present process returns back to the step Sa8 again. However, if the judgment result of the step Sa10 is "YES", the present process is returned from the present routine RU1. As shown in FIG. 49B, the calculation of the distance boundary value THL is performed.

Next, the player operates the mode switch 1001 so as to select the play mode. Thereafter, when the player depresses the key-on switch 1009, the musical tone is to be generated. Next, detailed description will be given with respect to the musical tone generating operation by referring to a flow chart representing a musical tone generating routine RU2 shown in FIG. 47B. In a first step Sb1, the CPU 1011 outputs the start pulse ST to the distance detecting circuit 1010 and then inputs the distance data DL from the distance detecting circuit 1010. In a next step Sb2, the value "0" is set to times j for comparing the measured distance L depending on the distance data DL with the distance boundary value THL stored in the distance boundary storing area TBLH, and then the present process advances to a next step Sb3. This step Sb3 judges whether the measured distance L is smaller than the distance boundary value $THL_j$ stored in a position having the address corresponding to the value j within the distance boundary storing area TBLH or not. If a judgment result of the step Sb3 is "YES", the present process advances to a step Sb6. However, if the judgment result of the step Sb3 is "NO", the present process advances to a next step Sb4.

The step Sb4 increases the value of the comparing times j by one, and then the present process advances to a next step Sb5. The step Sb5 judges whether the value of the comparing times j becomes larger than the value "3" or not. In other words, the step Sb5 judges whether the operation for comparing the measured distance L with the distance boundary value THL is completed or not. If a judgment result of the step Sb5 is "NO", the present process returns back to the step Sb3 again. However, if the judgment result of the step Sb5 is "YES", the present process advances to the next step Sb6. This step Sb6 generates the tone pitch data KC corresponding to the value j which is determined in the above-mentioned processes. Such tone pitch data KC and the key-on data KOD are outputted to the musical tone signal generating circuit 19, whereby the speaker SP generates the musical tone. As shown in FIG. 49C, each of the tone pitches do, re, mi, fa and so is assigned to each of the distance ranges which are divided by the distance boundary values THL. Hence, the CPU 1011 forces the musical tone signal generating circuit 19 to generate the musical tone having the tone pitch assigned to the distance range in which the measured distance L is included. Thereafter, the present process returns from the routine RU2.

As described heretofore, the fifteenth embodiment can vary the tone pitch of the musical tone by facing the palm of the player's hand toward the wall and depressing the key-on switch 1009 while the player moves his hand up and down.

Incidentally, the fifteenth embodiment controls the tone pitch of the musical tone based on the swinging angle of the player's hand or the distance between the palm of the player's hand and the wall, for example. However, the present invention is not limited to that. Hence, it is possible to re-design the fifteenth embodiment such that the tone pitch of the musical tone is controlled based on a holding intensity of the player's hand. In addition, it is also possible to control the tone color, the tone volume and the like, instead of the tone pitch.

Above is the description of the preferred embodiments. This invention may be practiced or embodied in still other ways without departing from the spirit or essential character thereof. Therefore, the preferred embodiments described herein are therefore illustrative and not restrictive, the scope of the invention being indicated by the appended claims and all variations which come within the meaning of the claims are intended to be embraced therein.

What is claimed is:

1. A musical tone control apparatus for controlling a musical tone to be generated by an external musical tone generating apparatus comprising:

(a) a stick having a shape which can be held by a player's hand;

(b) memory means for storing a plurality of tone colors;

(c) selecting means for selecting a tone volume and a tone color of said musical tone, said selecting means further comprising at least one push-button switch, wherein the number of said push-button switches is less than the number of said tone colors; and (d) control means for reading a desirable tone color selected by an operating state of said push-button switch from said memory means, said control means outputting a control signal corresponding to a desirable tone volume designated by said selecting means, whereby a musical tone having said desirable tone color and said desirable tone volume is to be generated by said external musical tone generating apparatus.

2. A musical tone control apparatus for controlling a musical tone to be generated comprising:

(a) a stick having a shape which can be held by a player's hand;

(b) selecting means for selecting a tone volume and a tone color of said musical tone, said selecting means being mounted on or equipped within said stick;

(c) memory means for storing a plurality of tone colors; and (d) control means for reading a desirable tone color selected by said selecting means from said memory means, said control means outputting a desirable tone volume designated by said selected means whereby a musical tone having said desirable tone color and said desirable tone volume is to be generated;

wherein said selecting means comprises at least a switch for selecting said desirable tone color, said switch being mounted on said stick, and an acceleration sensor for detecting a swinging acceleration applied to said stick and outputting a detection signal the level of which corresponds to said swinging acceleration, said acceleration sensor being equipped within said stick, said desirable tone volume being designated by the level of said detection signal.

3. A musical tone control apparatus according to claim 2 further comprising an interface circuit for passing an output signal of said switch to said control means wherein said desirable tone color is selected, said interface circuit generating digital data representative of said desirable tone volume based on the level of said detection signal, and said digital data being outputted to said control means wherein said desirable tone volume is designated.

4. A musical tone control apparatus according to claim 2, wherein said desirable tone color is selected in accordance with the times by which said switch is depressed by the player in a certain period.

5. A musical tone control apparatus according to claim 4 further comprising another switch for determining said certain period.

6. A musical tone control apparatus for controlling a musical tone to be generated by an external musical tone generating apparatus comprising:

(a) a stick having a shape which can be held by a player's hand;

(b) selecting means for selecting a tone volume and a tone color of said musical tone, said selecting means being mounted on or equipped within said stick, said selecting means comprising:

(i) a first acceleration sensor for detecting a first swinging acceleration of said stick in a first direction so as to generate a first detection signal; and (ii) a second acceleration sensor for detecting a second swinging acceleration of said stick in a second direction perpendicular to said first direction so as to separate a second detection signal, both of said first and second acceleration sensors being equipped within said stick, said tone color being selected based on said first and second detection signals;

(c) memory means for storing a plurality of tone colors; and (d) control means for reading a desirable tone color selected by said selecting means from said memory means, said control means outputting a control signal corresponding to a desirable tone volume designated by said selecting means, whereby a musical tone having said desirable tone color and said desirable tone volume is to be generated by said external musical tone generating apparatus.

7. A musical tone control apparatus for controlling a generation of a musical tone in a musical tone generating apparatus comprising:

(a) a stick which can be held by a player's hand;

(b) switching means mounted on said stick;

(c) angle detecting means for detecting a swinging angle of said stick when the player swings up said stick, said angle detecting means being equipped within said stick;

(d) a tone color memory for storing tone color information representative of a plurality of tone colors; and (e) control means for reading a desirable tone color information from said tone color memory in accordance with a detection of said detecting means when said switching means is in an operating state, wherein said control means is capable of controlling another quality of a musical tone, other than tone color, based on the swinging angle detected by said stick when said switching means is in another operating state, said desirable tone color information being supplied to said musical tone generating apparatus, whereby a tone color of a musical tone to be generated is controlled by said desirable tone color information.

8. A musical tone control apparatus for controlling a musical tone to be generated comprising:

(a) a stick having a shape which can be held by a player's hand;

(b) a first switch for controlling start of sounding of the musical tone;

(c) a second switch for setting a tone color of the musical tone, both of said first and second switches being respectively mounted on said stick;

(d) angle detecting means equipped within said stick, said angle detecting means detecting a swinging angle of said stick which is swung by a player;

(e) memory means for storing a plurality of predetermined tone colors respectively corresponding to predetermined angle ranges; and (f) control means for controlling the tone pitch of the musical tone based on detected swinging angle of said stick in response to an operating state of said first switch, said control means selecting and setting one of said predetermined tone colors corresponding to said predetermined angle range to which said detected swinging angle of said stick belongs in response to an operating state of said second switch, whereby a musical tone having the selected tone color and also having said tone pitch controlled by said control means is generated.

9. A musical tone control apparatus according to claim 8, wherein said control means controls said tone pitch of the musical tone while said first switch is operated, said control means changing said tone color of the musical tone when said second switch is operated but said first switch is not operated.

10. A musical tone control apparatus, for controlling a generation of a musical tone in a musical tone generating apparatus, comprising:

(a) a stick which can be held by a player;

(b) a transmitter mounted on an arm of said player who holds said stick by his hand;

(c) a receiver for receiving an output signal of said transmitter and providing a receiver output signal, said receiver being configured within said stick; and (d) control means for receiving said receiver output signal and outputting tone color information corresponding to said receiver output signal to said musical tone generating apparatus to thereby control a tone color of a musical tone to be generated.

11. A musical tone control apparatus for controlling a musical tone to be generated comprising:

(a) a stick having a shape which can be held by a player's hand;

(b) angle detecting means for detecting a swinging angle of said stick and providing swinging angle data, said angle detecting means being equipped within said stick;

(c) transmitter means for transmitting a radio wave having a predetermined frequency in the air, said transmitter means being put on a player's arm;

(d) receiver means for receiving said radio wave and outputting frequency data representative of said predetermined frequency, said receiver means being equipped within said stick; and (e) control means for receiving said swinging angle data from said angle detecting means and controlling a tone pitch of the musical tone based on said swinging angle of said stick detected by said angle detecting means and for also receiving said frequency data from said receiver means and changing a tone color of the musical tone based on said frequency data.

12. A musical tone control apparatus according to claim 11, wherein said receiver means comprises (a) a receiver for receiving said radio wave; and (b) frequency discriminating means for discriminating said predetermined frequency from other frequencies so as to generate said frequency data in response to a discriminating result thereof.

13. A musical tone control apparatus for controlling a generation of a musical tone in a musical tone generating apparatus comprising:

(a) a stick which can be held by a player's hand;

(b) a sensor module which can be freely mounted to and removed from said stick, said sensor module having a sensor for detecting a movement of a player's arm so that said sensor module outputs a detecting result of said sensor and discrimination information for identifying the type of said sensor mounted thereto; and (c) control means for generating a control signal based on said detecting result of said sensor and said discrimination information, said musical tone generating apparatus being controlled by said control signal.

14. A musical tone control apparatus for controlling a musical tone to be generated comprising:

(a) a stick having a shape which can be held by a player's hand;

(b) a sensor module which can be freely mounted to and removed from said stick, said sensor module including sensor means for detecting a movement of said player's hand holding said stick so that said sensor module outputs first data representative of a detected movement of said player's hand and second data representative of the type of said sensor means mounted to said sensor module; and (c) control means for controlling a tone pitch of said musical tone based on said first and second data.

15. A musical tone control apparatus according to claim 14, wherein said sensor module further includes discrimination means for outputting said second data.

16. A musical tone control apparatus according to claim 15, wherein said second data identifies said sensor means as one of an angle sensor for detecting a swinging angle of said stick and an acceleration sensor for detecting an acceleration applied to said stick, and wherein said first data represents said swinging angle or said acceleration of said stick.

17. A musical tone control apparatus according to claim 16 further including selector means for selecting an output of one of said angle sensor and said acceleration sensor based on said second data, whereby said selector means outputs a selected output as said first data.

18. A musical tone control apparatus for controlling a generation of a musical tone in a musical tone generating apparatus comprising:

(a) two sticks each being mounted with movement detecting means for detecting a movement of said stick and providing an output signal and an operating switch having at least two operating states; and (b) control means for controlling said musical tone generating apparatus in response to outputs of said movement detecting means and said switches wherein combinations of the operating states of the switches of said two sticks and the outputs of said movement detecting means determine tone color selection information for controlling said musical tone generating apparatus.

19. A musical tone control apparatus for controlling a musical tone to be generated comprising:

(a) two sticks each having a shape which can be held by a player's hand;

(b) two switches each mounted on each stick;

(c) two acceleration sensors each equipped within said each stick; and (d) control means for controlling a tone color of said musical tone based on operating states of said switches and output levels of said acceleration sensors.

20. A musical tone control apparatus for controlling a generating of a musical tone in an musical tone generating apparatus comprising:

(a) a stick which can be held by a player's hand;

(b) a plurality of key-on switches mounted on said stick, said plurality of key-on switches being electrically connected in parallel and generating key-on and key-off data in parallel;

(c) detecting means for detecting operating states of said key-on switches in parallel; and (d) control means for outputting a key-on control signal corresponding to a detecting result of said detecting means to said external musical tone generating apparatus, whereby said key-on control signal controls the external musical tone generating apparatus to start or stop generating said musical tone.

21. A musical tone control apparatus for controlling a musical tone to be generated comprising:

(a) a stick having a shape which can be held by a player's hand;

(b) at least two key-on switches each controlling start timing of sounding of said musical tone, said key-on switches being mounted on said stick;

(c) angle detector means for detecting a swinging angle of said stick, said angle detecting means being equipped within said stick; and (d) control means for controlling a tone pitch of said musical tone based on said swinging angle detected by said angle detector means at every time when one of said key-on switches is depressed, said control means stopping generating said musical tone when all of said key-on switches are released.

22. A musical tone control apparatus for controlling a musical tone to be generated comprising:

(a) a stick having at least a holding portion which can be held by a player's hand, and a tip portion having a predetermined length extending beyond said holding portion;

(b) angle detecting means for detecting a swinging angle of said player's hand holding said stick, said angle detecting means being equipped within said holding portion of said stick; and (c) control means for controlling a tone pitch of said musical tone based on said swinging angle detected by said angle detecting means.

23. A musical tone control apparatus according to claim 22 further comprising switching means for designating one of tone colors at every time when said switching means is depressed, said switching means being equipped within the tip portion of said stick, and said control means controlling a tone color of said musical tone to be identical to the designated tone color.

24. A musical tone control apparatus according to claim 23, wherein said switching means is constructed by a piezoelectric element.

25. A musical tone control apparatus comprising:

(a) angle detecting means providing a plurality of detecting switches each having a contact which is turned on or off in response to an inclination of a center axis of each detecting switch, said detecting switches being spirally arranged by forming angles among said center axes of said detecting switches so as to cancel an effect of a revolution due to a twisting of a player's wrist which is caused in a period when a player swings his hand holding said angle detecting means around his shoulder joint in his side direction; and (b) control signal generating means for generating a control signal for controlling a musical tone generating apparatus based on an output of said angle detecting means.

26. A musical tone control apparatus for controlling a musical tone to be generated comprising:

(a) two cylindrical sticks which can be held by player's both hands, a plurality of through holes being formed respectively in each cylindrical stick such that angles are respectively formed between center axes of said through holes and a reference line drawn in a radius direction of an upper or under plane of said cylindrical stick, whereby said center axes of said through holes are spirally arranged with respect to an axis line of said cylindrical stick;

(b) angle detecting means comprising a plurality of detecting switches each inserted into each of said through holes, each detecting switch having a contact which is turned on or off in response to an angle formed between a center axis of said each detecting switch and the plumb line; and (c) control means for controlling a tone pitch of said musical tone in response to outputs of said detecting switches.

27. A musical tone control apparatus according to claim 26, wherein four through holes are formed within said each cylindrical stick, and said angles being determined as 30 degrees, 75 degrees, 112.5 degrees and 157.5 degrees respectively, whereby said angle detecting means detects a swinging angle of said each cylindrical stick with accuracy by canceling an effect of a revolution due to a twisting of a player's wrist which is caused in a period when a player swings his hand holding said cylindrical stick around his shoulder joint in his side direction.

28. A musical tone control apparatus comprising:

(a) holding means equipped with a detector for detecting a movement of a player's hand, said holding means providing a holding portion having a shape which can be held by said player's hand. said shape of said holding portion being determined such that a mounted direction of said detector can be recognized by a sense of said player's hand; and (b) control signal generating means for generating a control signal for controlling a musical tone generating apparatus based on an output of said detector.

29. A musical tone control apparatus according to claim 28, wherein said shape of said holding portion is determined such that substantially the entire inner surface of said player's hand can be fitted with said holding portion.

30. A musical tone control apparatus according to claim 28, wherein said holding portion has a polygon shape.

31. A musical tone control apparatus according to claim 28, wherein said detector is an angle detector for detecting a swinging angle of said player's hand.

32. A musical tone control apparatus according to claim 28, wherein said detector is an acceleration sensor for detecting an acceleration applied thereto.

33. A musical tone control apparatus for controlling a musical tone to be generated comprising:

(a) a plurality of sensors each detecting an acceleration applied thereto in a predetermined direction, tone colors being assigned to said sensors respectively;

(b) a stick equipped with said sensors, said stick providing a holding portion which is shaped such that a player can recognize a mounted direction of said sensors with ease;

(c) control means for controlling a tone volume of said musical tone in response to said acceleration detected by said sensors, one tone color among said tone colors being selected in accordance with a swinging direction of said stick, whereby a musical tone having a selected tone color and also having a tone volume corresponding to said acceleration is to be generated.

34. A musical tone control apparatus according to claim 33, wherein said plurality of sensors comprises first and second acceleration sensors equipped within said stick, a cymbal tone and a bass drum tone being respectively assigned to said first and second acceleration sensors, said first acceleration sensor detecting an acceleration in a first direction so as to select said cymbal tone when said player swings said stick in said first direction, and said second acceleration sensor detecting an acceleration in a second direction so as to select said bass drum tone when said player swings said stick in said second direction.

35. A musical tone control apparatus for controlling a generation of a musical tone in a musical tone generating apparatus comprising:

(a) movement detecting means for detecting a movement of a player;

(b) a memory;

(c) a mode switch for selecting one of a play mode and a write mode;

(d) a write switch which is used when a detecting result of said movement detecting means is written in said memory;

(e) writing means for writing said detecting result of said movement detecting means into said memory in response to an operating state of said write switch in said write mode; and (f) control means for generating musical tone control data based on said detecting result of said movement detecting means and contents of data stored in said memory in said play mode, said musical tone control data being outputted to said musical tone generating apparatus.

36. A musical tone control apparatus for controlling a musical tone to be generated comprising:

(a) detecting means for detecting a movement of a player's arm;

(b) mode selecting means for selecting one of a tone pitch setting mode and a play mode;

(c) memory means for storing tone pitches corresponding to detected movement of said player's arm when said tone pitch setting mode is selected; and (d) control means for controlling said musical tone to have a desirable tone pitch among said tone pitches stored in said memory means in response to said movement of said player's arm when said play mode is selected.

37. A musical tone control apparatus according to claim 36, wherein said detecting means is an angle detector for detecting a swinging angle of said player's arm.

38. A musical tone control apparatus according to claim 37 further comprising an operation means for operating angle boundary values corresponding to respective swinging angles of said player when said tone pitch setting mode is selected, a whole swinging angle of said player's arm being divided into a plurality of angle ranges by said angle boundary values, each of predetermined tone pitches being assigned to each of said angle ranges, said musical tone being controlled to have a tone pitch corresponding to said angle range which includes a present swinging angle of said player's arm when said play mode is selected.

39. A musical tone control apparatus according to claim 36, wherein said detecting means is a distance measuring device for measuring a distance between a player's hand and a predetermined object.

40. A musical tone control apparatus according to claim 39, wherein said distance measuring device includes an ultrasonic transmitter and an ultrasonic receiver, said ultrasonic transmitter transmitting an ultrasonic wave to said predetermined object at a first time so that said ultrasonic wave is reflected by said predetermined object, said ultrasonic receiver receiving reflected ultrasonic wave from said predetermined object at a second time, and said distance between said player's hand and said predetermined object being determined based on a time difference between said first time and said second time.

41. A musical tone control apparatus for controlling a generation of a musical tone in a musical tone generating apparatus comprising:

(a) a stick which can be held by a player's hand;

(b) a tone color memory for storing tone color information representative of a plurality of tone colors;

(c) at least one push-button switch to be mounted on said stick, wherein the number of said push-button switches is less than the number of said tone colors; and (d) control means for reading desirable tone color information corresponding to one of said plurality of tone colors selected by an operating state of said push-button switch, from said tone color memory, said control means outputting said desirable tone color information to said musical tone generating apparatus wherein a musical tone having a tone color corresponding to said desirable tone color information is generated, wherein said control means selects one of said plurality of tone colors in accordance with the number of times by which said push-button switch is depressed by the player in a certain period, and reads said desirable tone color information corresponding to said selected tone color from said tone color memory.

42. A musical tone control apparatus for controlling a generation of a musical tone in a musical tone generating apparatus comprising:

(a) a stick which can be held by a player's hand;

(b) a tone color memory for storing tone color information representative of a plurality of tone colors;

(c) switching means mounted on said stick and comprising a switch which selects a desirable one tone color among said plurality of tone colors; and (d) control means for reading desirable tone color information corresponding to one of said plurality of tone colors selected from said tone color memory in accordance with the number of times which said switch is depressed by said player in a certain period, said control means outputting said desirable tone color information to said musical tone generating apparatus wherein a musical tone having a tone color corresponding to said desirable tone color information is to be generated.

43. A musical tone control apparatus for controlling generation of a musical tone in a musical tone generating apparatus comprising:

(a) a stick which can be held by a player's hand;

(b) a tone color memory for storing tone color information representative of a plurality of tone colors;

(c) at least one push-button switch mounted on said stick, wherein the number of said push-button switches is less than the number of said tone colors; and (d) control means, including means for counting the number of times said push-button switch is activated, for reading desired tone color information corresponding to one of said plurality of tone colors selected by the number of times said push-button switch is operated, from said tone color memory, said control means outputting said desirable tone color information to said musical tone generating apparatus wherein a musical tone having a tone color corresponding to said desired tone color information is generated.

44. A musical tone control apparatus for controlling generation of a musical tone in a musical tone generating apparatus comprising:

(a) a stick which can be held by a player's hand;

(b) a tone color memory for storing tone color information representative of a plurality of tone colors;

(c) a plurality of push-button switches mounted on said stick, wherein the number of said push-button switches is less than the number of said tone colors; and (d) control means for reading desired tone color information corresponding to one of said plurality of tone colors selected by the combination of on/off states of said push-button switches, said control means outputting said desirable tone color information to said musical tone generating apparatus wherein a musical tone having a tone color corresponding to said desired tone color information is generated.

45. A musical tone control apparatus for controlling a musical tone to be generated by an external musical tone generating apparatus comprising:

(a) a stick having a shape which can be held by a player's hand;

(b) memory means for storing a plurality of tone colors;

(c) selecting means for selecting a tone volume and a tone color of said musical tone, said selecting means further comprising at least one push-button switch, wherein the number of said push-button switches is less than the number of said tone colors; and (d) control means, including means for counting the number of times said push-button switch is operated, for reading a desired tone color from said memory means selected by the number of times said push-button switch is operated, said control means outputting a control signal corresponding to a desired tone volume designated by said selecting means, whereby a musical tone having a desired tone color and a desired tone volume is generated by said external musical tone generating apparatus.

46. A musical tone control apparatus for controlling a musical tone to be generated by an external musical tone generating apparatus comprising:

(a) a stick having a shape which can be held by a player's hand;

(b) memory means for storing a plurality of tone colors;

(c) selecting means for selecting a tone volume and a tone color of said musical tone, said selecting means further comprising a plurality of push-button switches, wherein the number of said push-button switches is less than the number of said tone colors; and (d) control means for reading a desired tone color, selected by the combination of on/off states of said push-button switches, from said memory means, said control means outputting a control signal corresponding to a desired tone volume designated by said selecting means, whereby a musical tone having said desired tone color and said desired tone volume is generated by said external musical tone generating apparatus.

* * * * *